US007952556B2

(12) United States Patent
Honbo

(10) Patent No.: US 7,952,556 B2
(45) Date of Patent: May 31, 2011

(54) LIQUID CRYSTAL DISPLAY DEVICE, DRIVING CONTROL CIRCUIT AND DRIVING METHOD USED IN SAME DEVICE

(75) Inventor: Nobuaki Honbo, Kanagawa (JP)

(73) Assignee: NEC LCD Technologies, Ltd, Tokyo (JP)

( * ) Notice: Subject to any disclaimer, the term of this patent is extended or adjusted under 35 U.S.C. 154(b) by 892 days.

(21) Appl. No.: 11/775,009

(22) Filed: Jul. 9, 2007

(65) Prior Publication Data

US 2008/0007512 A1 Jan. 10, 2008

(30) Foreign Application Priority Data

Jul. 10, 2006 (JP) ..... 2006-189352

(51) Int. Cl.
*G09G 3/36* (2006.01)

(52) U.S. Cl. ..... 345/102

(58) Field of Classification Search ..... 345/102, 345/87–90, 94

See application file for complete search history.

(56) References Cited

U.S. PATENT DOCUMENTS 7,333,101 B2 * 2/2008 Bu et al. ..... 345/208
2002/0122020 A1 * 9/2002 Moon et al. ..... 345/89
2005/0083282 A1 * 4/2005 Honbo ..... 345/87
2005/0140639 A1 * 6/2005 Oh et al. ..... 345/102
2006/0007100 A1 * 1/2006 Hong et al. ..... 345/102
2006/0109234 A1 * 5/2006 Hong et al. ..... 345/102
2006/0146005 A1 * 7/2006 Baba et al. ..... 345/102
2007/0257873 A1 * 11/2007 Kim et al. ..... 345/87

FOREIGN PATENT DOCUMENTS

JP 2005-258404 A 9/2005

* cited by examiner

*Primary Examiner* — Richard Hjerpe
*Assistant Examiner* — Jeffrey Parker
(74) *Attorney, Agent, or Firm* — Sughrue Mion, PLLC

(57) ABSTRACT

A liquid crystal display device capable of improving quality of moving images is provided. Each LED (Light Emitting Diode) block is turned ON according to a response of a liquid crystal corresponding to a light emitting region and the brightest gray level is detected for each of red (R), green (G) and blue (B) of an input video signal in every frame period and an input video signal is converted into a value obtained by being multiplied by an upper limit gray level and then by being divided by the brightest gray level and a gray level voltage corresponding to the converted value is applied to each data electrode and, during a lighting period of LED blocks, each LED block is made to flash at a duty corresponding to a rate of the brightest gray level to the upper limit gray level.

25 Claims, 17 Drawing Sheets

LIQUID CRYSTAL DISPLAY DEVICE, DRIVING CONTROL CIRCUIT AND DRIVING METHOD USED IN SAME DEVICE

INCORPORATION BY REFERENCE

This application is based upon and claims the benefit of priority from Japanese Patent Application No. 2006-189352, filed on Jul. 10, 2006, the disclosure of which is incorporated herein in its entirely by reference.

BACKGROUND OF THE INVENTION

1. Field of the Invention

The present invention relates to a liquid crystal display device, driving control circuit and driving method used in the same display device, and more particularly to the liquid crystal display device having an LED (Light Emitting Diode) backlight and suitably used when a moving image is displayed, the driving control circuit and the driving method used in the same display device.

2. Description of the Related Art

To display a television image, a CRT (Cathode Ray Tube) has been conventionally used, however, in recent years, liquid crystal display devices are widely used. In each of the liquid crystal display devices, a liquid crystal display panel is a non-luminous panel and, therefore, a backlight is placed on a rear of the liquid crystal panel and images are displayed by changing transmittance of light emitted from the backlight according to an input video signal. However, the liquid crystal panel as the related art has a problem. That is, when black is displayed on the liquid crystal panel, if a backlight is ordinarily turned ON, leakage of light from a displaying surface of the liquid crystal panel occurs, which causes contrast to be degraded.

In addition, a CRT display panel is self-luminous and, therefore, a dynamic range of luminance can be widened by changing peak luminance according to an input video signal, whereas the liquid crystal display panel in the liquid crystal display device is non-luminous and, as a result, widening of a dynamic range of luminance is difficult. Another problem is that, when moving images are displayed by the liquid crystal display device, since a response of a liquid crystal to an applied voltage requires time and since a holding-type driving operation is performed in which a current frame is held until a video signal corresponding to a succeeding frame is supplied, a trail-leaving (afterimage) phenomenon occurs. Thus, an improved liquid crystal display device that tries to solve these problems is proposed.

Related art technology of this type is disclosed in, for example, in Japanese Patent Application Laid-open No. 2005-258404 (Abstract, FIGS. 13 and 30). The disclosed liquid crystal display device, as shown in FIG. 15, includes an external light sensor 1, a controller 2, a display data changing circuit 3, a backlight light amount controlling circuit 4, a liquid crystal display section 5, a backlight 6, and an optical sensor 7. In the disclosed liquid crystal display device, the controller 2 controls, based on a signal "pe" output from the optical sensor 7 to detect emission of light from the backlight 6, on an image signal "vf" input to be used for displaying on the liquid crystal display section 5, and on a signal "pg" output from the external light sensor 1 to detect external environmental light, a process of changing displaying data for each color (red (R), green (G), and blue (B)) in the liquid crystal display section 5 and an amount of light, for each color (R, G, B), emitted from the backlight 6.

In the disclosed case, as shown in FIG. 16, the backlight 6 is turned ON in every frame period with time width corresponding to converting indices from 100 to 255 of luminance of an illumination light source that change in inverse proportion to optical transmittance of liquid crystals. As a result, contrast of a displayed image and a dynamic range of luminance are improved. In addition, by flashing of the backlight 6, a trail-leaving phenomenon of moving images on a displayed screen is reduced.

However, the above liquid crystal display device as the related art has the following problems. That is, in the related art liquid crystal display device in FIG. 15, as shown in FIG. 17A, when a gray level of a video signal to be input is comparatively low, a response of a liquid crystal is slow which causes lighting timing of the backlight 6 to be delayed, whereas, when a gray level of a video signal to be input is comparatively high, a response of the liquid crystal is rapid, which causes rapid lighting timing of the backlight 6. Thus, lighting timing of the backlight 6 differs greatly depending on the gray level of a video signal to be input and, therefore, when a moving picture is displayed, a degree of a trail-leaving phenomenon differs depending on the gray level of an input video signal, causing degradation of quality of images.

SUMMARY OF THE INVENTION

In view of the above, it is an object of the present invention to provide a liquid crystal display device capable of preventing degradation of image quality even in displaying moving images, a driving control circuit to be used in the liquid crystal display device, and its driving method.

According to a first aspect of the present invention, there is provided a liquid crystal display device including:

a liquid crystal display panel;

a backlight; and a driving control unit;

wherein the liquid crystal display panel displays images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage;

wherein the backlight illuminates the liquid crystal display panel from its rear side; and wherein the driving control unit turns off the backlight during a frame period of the input video signal in which an upper limit gray level for each of red (R), green (G), and blue (B) is set until the liquid crystal shows a response to the application of the specified gray level voltage in the pixel region and turns on the backlight at a point of time when the liquid crystal has shown a response and detects a brightest gray level for each of the R, G, and B of the input video signal in every frame period and converts a gray level of the input video signal so that the detected brightest gray level and a corresponding upper limit gray level become at a same level and, during a lighting period of the backlight, makes the backlight flash at a duty corresponding to a rate of the brightest gray level to the corresponding upper limit gray level.

In the foregoing, a preferable mode is one wherein the data electrodes of the liquid crystal display panel are arranged in parallel to one another at specified intervals along a first direction and the scanning electrodes are arranged in parallel to one another at specified intervals along a second direction orthogonal to the first direction and wherein the backlight includes a plurality of light source blocks whose light emitting region is divided into m ("m" is an integer being 1 or more) portions in the first direction of the liquid crystal display device and into k ("k" is an integer being 2 or more) portions in the second direction and wherein the driving control unit turns on the light source blocks during a specified period according to a response of the liquid crystal corresponding to a light emitting region of each of the light source blocks and detects a brightest gray level for each of the R, G, and B of the input video signal in each frame period in a manner to correspond to each of the light source blocks and converts a gray level of the input video signal so that the detected brightest gray level and the upper limit gray level become at a same level and, during a lighting period of the light source blocks, makes the backlight flash at a duty corresponding to a rate of the brightest gray level to the upper limit gray level.

According to a second aspect of the present invention, there is provided a liquid crystal display device including:

a liquid crystal display panel;

a backlight; and a driving control unit;

wherein the liquid crystal display panel displays images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage;

wherein the backlight illuminates the liquid crystal display panel from its rear side; and wherein the driving control unit turns off the backlight during a frame period of the input video signal in which an upper limit gray level for each of the R, G, and B is set until the liquid crystal shows a response to the application of the specified gray level voltage in the pixel region and turns on the backlight at a point of time when the liquid crystal has shown a response and detects an average value of gray levels within a specified range including the brightest gray level for each of the R, G, and B of the input video signal in every frame period in a manner to correspond to each of the light source blocks and converts a gray level of the input video signal so that the detected average value of gray levels and a corresponding upper limit gray levels become at a same level and, during a lighting period of the backlight, makes the backlight flash at a duty corresponding to a rate of the average value to the corresponding upper limit gray level.

In the foregoing, a preferable mode is one wherein the data electrodes of the liquid crystal display panel are arranged in parallel to one another at specified intervals along a first direction and the scanning electrodes are arranged in parallel to one another at specified intervals along a second direction orthogonal to the first direction and wherein the backlight includes a plurality of light source blocks whose light emitting region is divided into m ("m" is an integer being 1 or more) portions in the first direction of the liquid crystal display device and into k ("k" is an integer being 2 or more) portions in the second direction and wherein the driving control unit turns on the light source blocks during a specified period according to a response of the liquid crystal corresponding to a light emitting region of each of the light source blocks and detects an average value of gray levels within a specified range including the brightest gray level for each of the R, G, and B of the input video signal in every frame period in a manner to correspond to each of the light source blocks and converts a gray level of the input video signal so that the detected average value of gray levels and the upper limit gray levels become at a same level and, during a lighting period of the backlight, makes the backlight flash at a duty corresponding to a rate of the average value to the upper limit gray level.

Also, a preferable mode is one wherein an average value of the gray levels is obtained by detecting gray levels corresponding to pixels within a specified range and by averaging values resulting from the detection, using a pixel having the brightest gray level in every frame period as a reference.

Also, a preferable mode is one wherein the backlight includes LEDs of, each at least, the R, G, and B.

Also, a preferable mode is one wherein the point of time when the liquid crystal has shown a response is set to be a first point of time when approximately up to 70% of the liquid crystals have shown a response or to be a second point of time after the first point.

Also, a preferable mode is one wherein the driving control unit performs an overdriving operation to the pixel region in every frame period.

Also, a preferable mode is one wherein the driving control unit divides each frame of the input video signal input at a specified frame frequency into M ("M" is an integer being 2 or more) pieces of sub-frames having a sub-frame frequency M times higher than the frame frequency and performs an overdriving operation on the corresponding pixel region in the first sub-frame in every frame period and performs an ordinary driving operation in the second and thereafter sub-frames.

Also, a preferable mode is one wherein the driving control unit turns on the backlight N ("N" is an integer being 2 or more) times at specified intervals in every frame period.

According to a third aspect of the present invention, there is provided a driving control circuit to be used in a liquid crystal display device including a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, the driving control circuit including:

components to turn off the backlight during a frame period of the input video signal in which an upper limit gray level for each of the R, G, and B is set until the liquid crystal shows a response to the application of the specified gray level voltage in the pixel region and to turn on the backlight at a point of time when the liquid crystal has shown a response and to detect a brightest gray level for each of the R, G, and B of the input video signal in the frame period and to convert a gray level of the input video signal so that the detected brightest gray level and a corresponding upper limit gray level become at a same level and, during a lighting period of the backlight, to make the backlight flash at a duty corresponding to a rate of the brightest gray level to the corresponding upper limit gray level.

In the foregoing, a preferable mode is one wherein the data electrodes of the liquid crystal display panel are arranged in parallel to one another at specified intervals along a first direction and the scanning electrodes are arranged in parallel to one another at specified intervals along a second direction orthogonal to the first direction and wherein the backlight includes a plurality of light source blocks whose light emitting region is divided into m ("m" is an integer being 1 or more) portions in the first direction of the liquid crystal display device and into k ("k" is an integer being 2 or more) portions in the second direction and wherein the components further turns on the light source blocks during a specified period according to a response of the liquid crystal corresponding to a light emitting region of each of the light source blocks and detects a brightest gray level for each of the R, G, and B of the input video signal in every frame period in a manner to correspond to each of the light source blocks and converts a gray level of the input video signal so that the detected brightest gray level and the upper limit gray level become at a same level and, during a lighting period of the light source blocks, makes the backlight flash at a duty corresponding to a rate of the brightest gray level to the upper limit gray level.

According to a fourth aspect of the present invention, there is provided a driving control circuit to be used in a liquid crystal display device including a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, the driving control circuit including:

components to turn off the backlight during a frame period of the input video signal in which an upper limit gray level for each of the R, G, and B is set until the liquid crystal shows a response to the application of the specified gray level voltage in the pixel region and to turn on the backlight at a point of time when the liquid crystal has shown a response and to detect an average value of gray levels within a specified range including a brightest gray level for each of the R, G, and B of the input video signal in each frame period in a manner to correspond to each of the light source blocks and to convert a gray level of the input video signal so that the detected average value of gray levels and a corresponding upper limit gray levels become at a same level and, during a lighting period of the backlight, to make the backlight flash at a duty corresponding to a rate of the average value to the corresponding upper limit gray level.

In the foregoing, a preferable mode is one wherein the data electrodes of the liquid crystal display panel are arranged in parallel to one another at specified intervals along a first direction and the scanning electrodes are arranged in parallel to one another at specified intervals along a second direction orthogonal to the first direction and wherein the backlight includes a plurality of light source blocks whose light emitting region is divided into m ("m" is an integer being 1 or more) portions in the first direction of the liquid crystal display device and into k ("k" is an integer being 2 or more) portions in the second direction and wherein the components turn on the light source blocks during a specified period according to a response of the liquid crystal corresponding to a light emitting region of each of the light source blocks and detect an average value of gray levels within a specified range including the brightest gray level for each of the R, G, and B of the input video signal in every frame period in a manner to correspond to each of the light source blocks and convert a gray level of the input video signal so that the detected average value of gray levels and the upper limit gray levels become at a same level and, during a lighting period of the backlight, make the backlight flash at a duty corresponding to a rate of the average value to the upper limit gray level.

Also, a preferable mode is one wherein the driving control circuit includes one integrated circuit.

According to a fifth aspect of the present invention, there is provided a driving method to be used in a liquid crystal display device including a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, the driving method including:

turning off the backlight during a frame period of the input video signal in which an upper limit gray level for each of the R, G, and B is set until the liquid crystal shows a response to the application of the specified gray level voltage in the pixel region, turning on the backlight at a point of time when the liquid crystal has shown a response, detecting the brightest gray level for each of the R, G, and B of the input video signal in the frame period, converting a gray level of the input video signal so that the detected brightest gray level and a corresponding upper limit gray level become at a same level and, during a lighting period of the backlight, making the backlight flash at a duty corresponding to a rate of the brightest gray level to the corresponding upper limit gray level.

In the foregoing, a preferable mode is one wherein the data electrodes of the liquid crystal display panel are arranged in parallel to one another at specified intervals along a first direction and the scanning electrodes are arranged in parallel to one another at specified intervals along a second direction orthogonal to the first direction and wherein the backlight includes a plurality of light source blocks whose light emitting region is divided into m ("m" is an integer being 1 or more) portions in the first direction of the liquid crystal display device and into k ("k" is an integer being 2 or more) portions in the second direction and wherein the driving method further includes steps of turning on the light source blocks during a specified period according to a response of the liquid crystal corresponding to a light emitting region of each of the light source blocks, of detecting the brightest gray level for each of the R, G, and B of the input video signal in each frame period in a manner to correspond to each of the light source blocks, of converting a gray level of the input video signal so that the detected brightest gray level and the upper limit gray level become at a same level and, during a lighting period of the light source blocks, of making the backlight flash at a duty corresponding to a rate of the brightest gray level to the upper limit gray level.

According to a sixth aspect of the present invention, there is provided a driving method to be used in a liquid crystal display device including a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, the driving method including:

turning off the backlight during a frame period of the input video signal in which an upper limit gray level for each of the R, G, and B is set until the liquid crystal shows a response to the application of the specified gray level voltage in the pixel region, turning on the backlight at a point of time when the liquid crystal has shown a response, detecting an average value of gray levels within a specified range including a brightest gray level for each of the R, G, and B of the input video signal in every frame period in a manner to correspond to each of the light source blocks, converting a gray level of the input video signal so that the detected average value of gray levels and a corresponding upper limit gray levels become at a same level and, during a lighting period of the backlight, and making the backlight flash at a duty corresponding to a rate of the average value to the corresponding upper limit gray level.

In the foregoing, a preferable mode is one wherein the data electrodes of the liquid crystal display panel are arranged in parallel to one another at specified intervals along a first direction and the scanning electrodes are arranged in parallel to one another at specified intervals along a second direction orthogonal to the first direction and wherein the backlight includes a plurality of light source blocks whose light emitting region is divided into m ("m" is an integer being 1 or more) portions in the first direction of the liquid crystal display device and into k ("k" is an integer being 2 or more) portions in the second direction and wherein the driving method includes steps of turning on the light source blocks during a specified period according to a response of the liquid crystal corresponding to a light emitting region of each of the light source blocks, of detecting an average value of gray levels within a specified range including a brightest gray level for each of the R, G, and B of the input video signal in every frame period in a manner to correspond to each of the light source blocks, of converting a gray level of the input video signal so that the detected average value of gray levels and the upper limit gray levels become at a same level and, during a lighting period of the backlight, and of making the backlight flash at a duty corresponding to a rate of the average value to the upper limit gray level.

With the above configurations, by the driving control section, the backlight is turned OFF during the frame period of the input video signal in which an upper limit gray level for each of the R, G and B is set until the liquid crystal shows a response to the application of a specified voltage to the pixel region of the liquid crystal display panel, whereas, at the time of the response of the liquid crystal, the backlight is turned ON and the brightest gray level for each of the R, G, and B of the input video signal in every frame period is detected and a gray level of the input video signal is converted so that the detected brightest gray level and the above upper limit are at the same level and, during the lighting period of the backlight, the backlight is made to flash at a duty corresponding to a rate of the above brightest gray level to the above upper gray level and, therefore, a trail-leaving phenomenon in displayed moving images can be reduced and contrast of the displayed image and dynamic range of luminance can be improved.

With another configuration as above, by the driving control section, each of the light source blocks is turned ON according to a response to a liquid crystal corresponding to a light-emitting region of each of the light source blocks and the brightest gray level for each of the R, G, and B of the input video signal is detected in every frame period and a gray level of the input video signal is converted so that the detected brightest gray level and the above upper limit gray level become at the same level and, during the lighting period of each of the light source blocks, the backlight is made to flash at a duty corresponding to a rate of the brightest gray level to the above upper limit gray level and, therefore, a resolution of the displayed images is improved and trail-leaving in the displayed moving images is reduced and, further, contrast of displayed images and dynamic range of luminance are improved.

With still another configuration as above, by the driving control section, the backlight is turned OFF during the frame period of the input video signal in which an upper limit gray level for each of the R, G, an B is set until the liquid crystal shows a response to the application of a specified voltage to the pixel region of the liquid crystal display panel, whereas, at the time of the response of the liquid crystal, the backlight is turned ON during a specified time and an average value of gray levels within a specified range including the brightest gray level for each of the R, G, and B of the input video signal in every frame period is detected and the gray level is converted so that the detected average value and the above upper limit gray level become at the same level and, during the lighting period of the backlight, the backlight is made to flash at a duty corresponding to a rate of the average value to the upper limit gray level and, therefore, trail-leaving in displayed moving images is reduced and contrast of displayed images and dynamic range of luminance are improved.

With still another configuration as above, by the driving control section, each of the light source blocks is turned ON according to a response of the liquid crystal corresponding to a light-emitting region of each of the light source blocks and an average value of gray levels within a specified range including the brightest gray level for each of the R, G, and B of the input video signal in every frame period in a manner to correspond to each of the light source blocks is detected and the gray level of the input video signal is converted so that the detected average value and the above upper limit gray level become at the same level and, during the lighting period of each of the light source blocks, the backlight is made to flash at a duty corresponding to a rate of the average value to the upper limit gray level and, therefore, a resolution of displayed images is improved and trail-leaving in displayed moving images is reduced and, further, contrast of displayed images and dynamic range of luminance are improved.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings. A liquid crystal display device is provided in which each of light source blocks is turned ON, for a specified period, according to a response of a liquid crystal corresponding to a light-emitting region of each of the light source blocks of a backlight and the brightest gray level for each of the R, G, B of an input video signal in every frame period is detected in a manner to correspond to each of the light source blocks and a gray level is converted of the input video signal so that the brightest gray level and an upper limit gray level of the input video signal become at the same level and, during a lighting period of the backlight, the backlight is made to flash at a duty corresponding to a rate of the brightest gray level to the upper limit value and a driving control circuit to be used in the liquid crystal display device and its driving method.

First Embodiment

Figure 1:
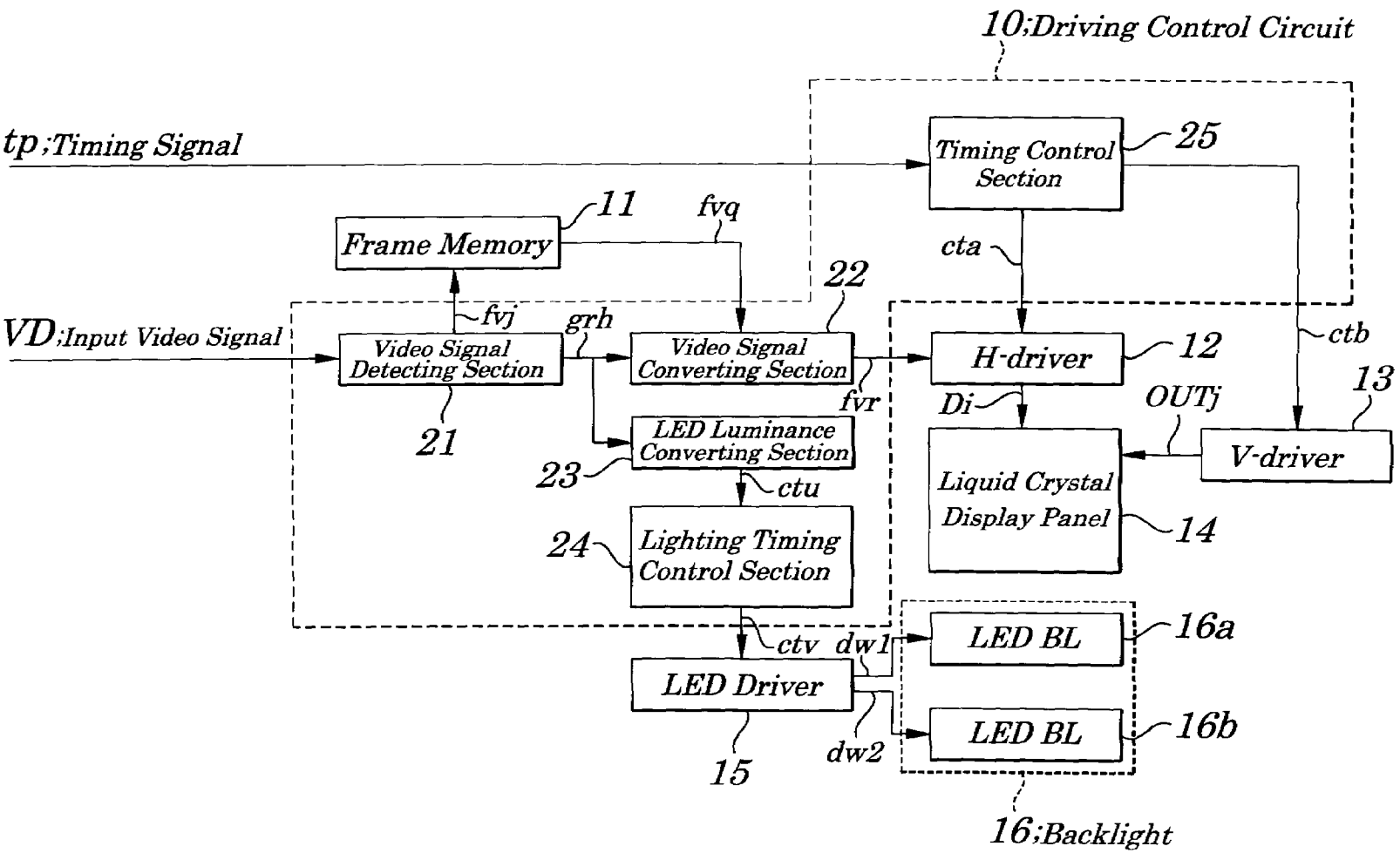
FIG. 1 is a block diagram showing electrical configurations of main components of a liquid crystal display device according to a first embodiment of the present invention.

FIG. 1 is a block diagram showing electrical configurations of main components of a liquid crystal display device according to a first embodiment of the present invention. The liquid crystal display device of the first embodiment, as shown in FIG. 1, includes a driving control circuit 10, a frame memory 11, an H-driver 12, a V-driver 13, a liquid crystal display panel 14, an LED driver 15, and a backlight 16. The driving control circuit 10 has a video signal detecting section 21, a video signal converting section 22, an LED luminance converting section 23, a lighting timing control section 24, and a timing control section 25. The driving control circuit 10 is integrated into, for example, one IC (Integrated Circuit).

The video signal detecting section 21 detects, in a manner to correspond to each of LED blocks (LED BL) 16*a* and 16*b*, the brightest gray level for each of the R, G, and B of an input video signal VD, in every frame period, and sends out the detected brightest gray level, as a maximum gray level "grh", to both the video signal converting section 22 and LED luminance converting section 23 and, further, sends out a video signal "fvj" of the input video signal VD, in every frame period, to the frame memory 11. The frame memory 11 stores a video signal "fvj" fed from the video signal detecting section 21 in every frame period and transmits the stored signal as video signal data "fvq" for every one frame to the video signal converting section 22. The video signal converting section 22 converts a gray level of the video signal "fvq" fed from the frame memory 11 so that the above brightest gray level (maximum gray level "grh") and an upper limit gray level (for example, 6 bits, 26=64 gray levels) of the input video signal VD become at the same level and sends out the converted signal, as the converted video signal "fvr", to the H-driver 12.

The LED luminance converting section 23 outputs, during a lighting period of each of LED blocks 16*a* and 16*b*, a control signal to make each of the LED blocks 16*a* and 16*b* flash at a duty corresponding to a rate of the above maximum gray level "grh" to the upper limit gray level of the input video signal VD to the lighting timing control section 24. The lighting timing control section 24 sends out a control signal "ctu" to make each of the LED blocks 16*a* and 16*b* flash at a duty rate based on the control signal "ctu" according to a response of a liquid crystal corresponding to light emitting region of each of the LED blocks 16*a* and 16*b* to the LED driver 15. In this case, a time point of the completion of a response of a liquid crystal is set to be a first point of time when approximately up to 70% or more of the liquid crystals have shown a response or to be a second point of time after the first time point (for example, when up to 90% or more of the liquid crystals have shown a response) and each of the LED blocks 16*a* and 16*b* is set so as to go off till the response is completed, while flashing of each of the LED blocks 16*a* and 16*b* is made to start at a time of the completion of the response. The LED driver 15 generates driving voltages "dw1" and "dw2" to make each of the LED blocks 16*a* and 16*b* flash based on a control signal "ctv" fed from the light timing control section 24.

The timing control section 25 sends out a control signal "cta" to the H-driver 12 and a control signal "ctb" to the V-driver based on a timing signal "tp" input from outside. The H-driver 12 transmits a display signal "Di" to the liquid crystal display panel 14 based on the control signal "cta" fed from the timing control section 25 and the converted video signal data "fvr" fed from the video signal converting section 22. The V-driver 13 sends out a scanning signal "OUTj" to the liquid crystal display panel 14 based on a control signal "ctb" fed from the timing control section 25. The liquid crystal display panel 14 receives a gray level voltage corresponding to the display signal "Di" in a corresponding pixel region by a driving operation of each scanning electrode (not shown) and each data electrode (not shown) and by control on a response of the liquid crystal in the display image to obtain a displayed image.

Figure 2:
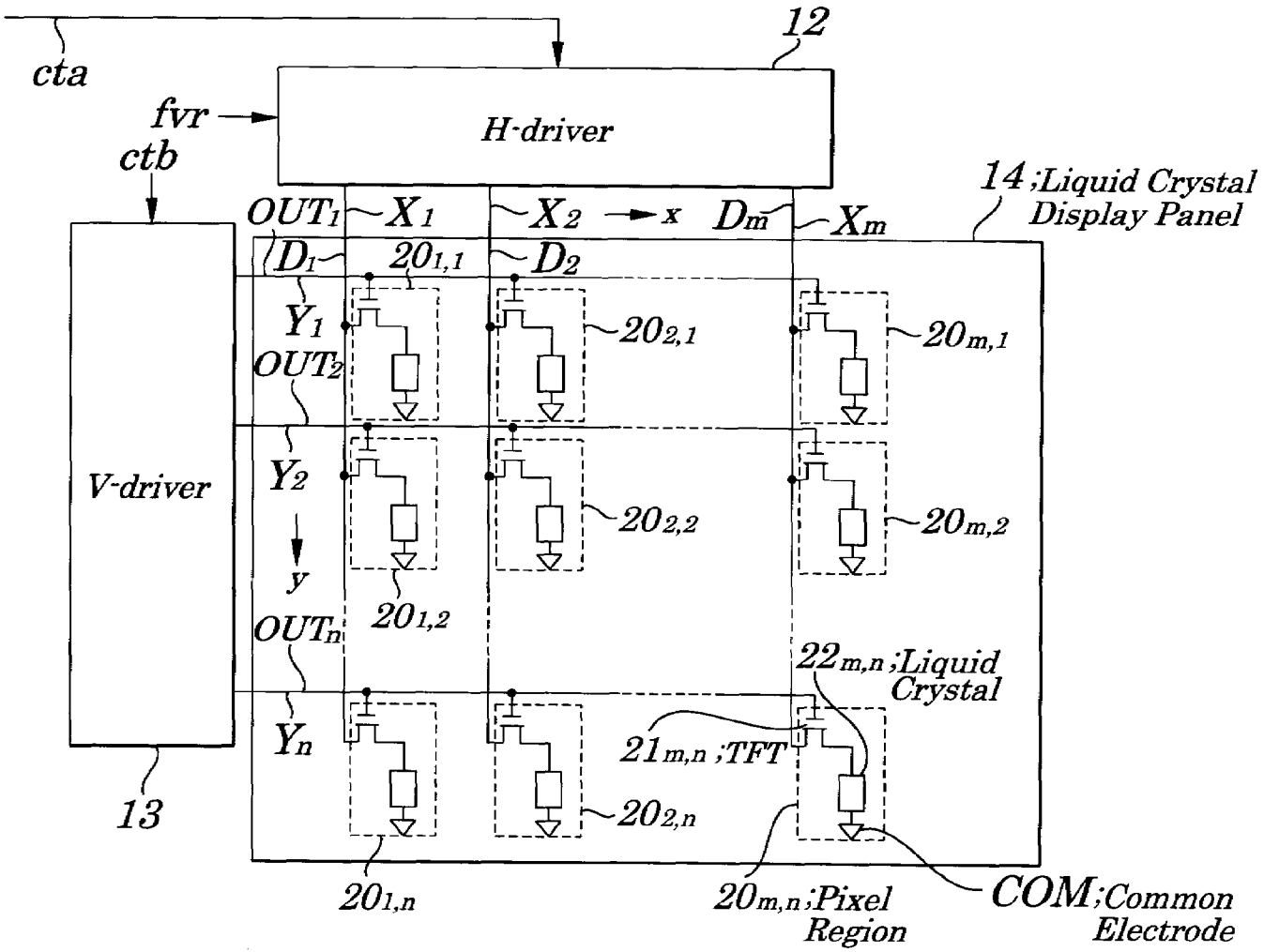
FIG. 2 is a schematic diagram showing one example of electrical configurations of the liquid crystal panel of FIG. 1.

FIG. 2 is a diagram showing one example of electrical configurations of the liquid crystal display panel 14 of FIG. 1. The liquid crystal display panel 14 of the embodiment is of a transmissive-type that allows light from the backlight 16 to come therein and includes, as shown in FIG. 2, data electrodes Xi (i=1, 2, . . . , m; for example, m=640×3) and scanning electrodes Yj (j=1, 2, . . . , n; for example, n=480). The data electrodes Xi are arranged at specified intervals in an "x" direction (that is, in the first direction) to each of which a corresponding display signal "Di" is applied. The scanning electrodes Yj are arranged at specified intervals in a "y" direction (that is, in a scanning direction or in a second direction) orthogonal to the x direction to each of which a scanning signal "OUTj" to write the display signal "Di" is line-sequentially applied. Each of pixel regions 20*i,j* is arranged in an intersection region of each of the data electrodes Xi and each of the scanning electrodes Yj in a one-to-one relationship and includes TFTs (Thin Film Transistors) 21*i,j*, liquid crystals 22*i, j*, common electrodes COM. Each of the TFTs 21*i,j* is ON/OFF controlled according to a scanning signal "OUTj" and is configured to apply the display signal "Di" to the liquid crystals 22*i,j* when getting into an ON state.

In the liquid crystal display panel 14, each of the scanning electrodes Yj and each of the data electrodes Xi are driven in a manner in which the scanning signal "OUTj" is line-sequentially to each of the scanning electrodes Yj and the display signal "Di" is supplied to each of the data electrodes Xi and, as a result, a specified gray voltage is applied to a pixel region corresponding to the display signal "Di" and a response of a liquid crystal making up the liquid crystal layer of the liquid crystal display panel 14 is controlled based on the applied gray level voltage, which changes optical transmittance of the liquid crystals and produces displayed images. The H-driver simultaneously applies, based on the control signal "cta" fed from the timing control section 25 and the converted video signal "fvr" fed from the video signal converting section, the display signal "Di" to each of the data electrodes Xi of the liquid crystal display panel 14. The V-driver line-sequentially applies, based on the control signal "ctb" fed from the timing control section 25, the scanning signal "OUTj" to each of the scanning electrodes Yj of the liquid crystal display panel 14.

Figure 3:
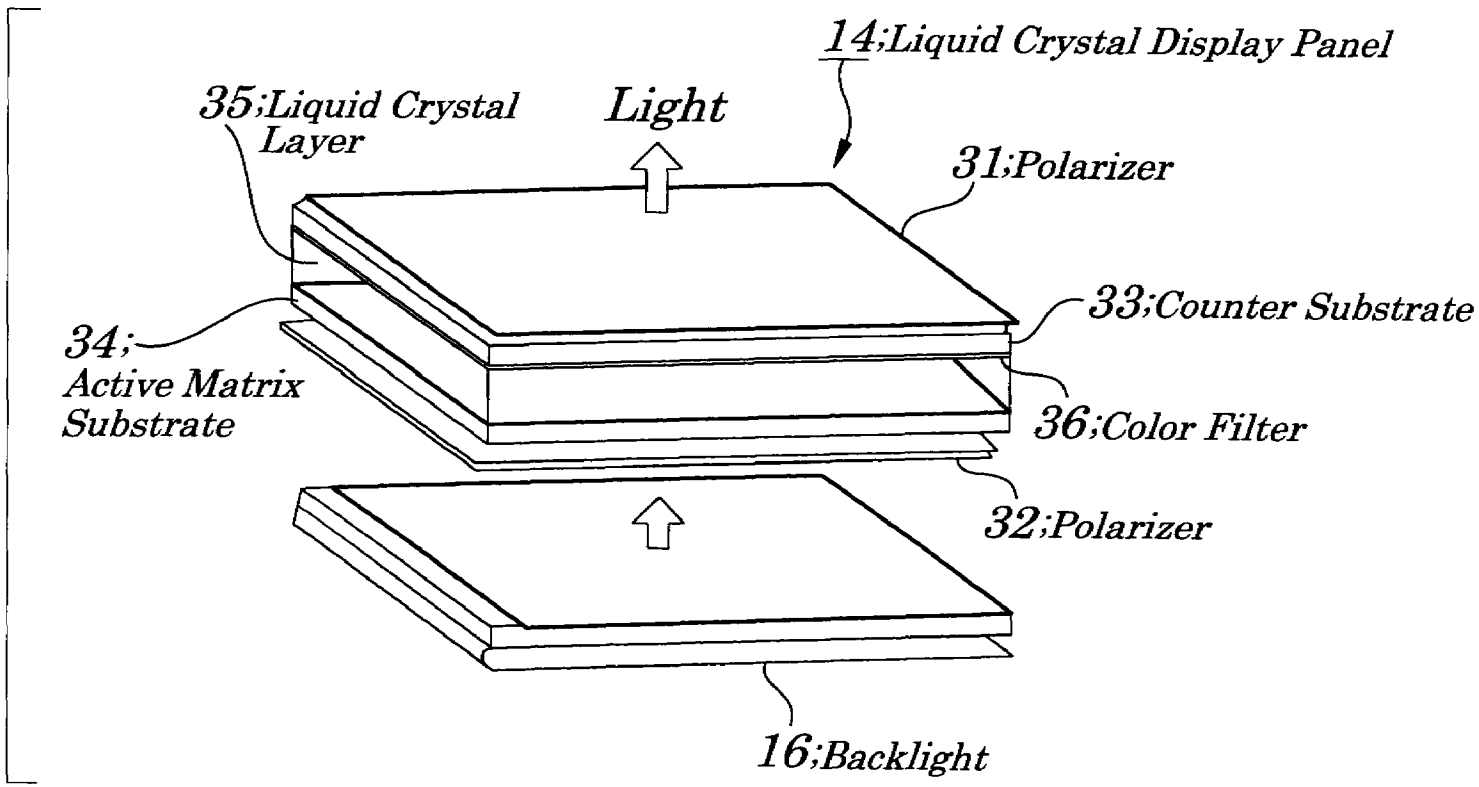
FIG. 3 is a diagram showing schematic configurations of the liquid crystal display panel and a position of the backlight shown in FIG. 1.

FIG. 3 is a diagram showing schematic configurations of the liquid crystal display panel 14 and a position of the backlight 16 shown in FIG. 1. The liquid crystal display panel 14, as shown in FIG. 3, is made up of a pair of polarizers 31 and 32, a counter substrate 33, an active matrix substrate 34, a liquid crystal layer 35 interposed between the counter substrate 33 and active matrix substrate 34. On the counter substrate 33 are formed the COM electrodes in FIG. 2 and a color filter of R, G, and B, in which one dot is made up of 3 pixels corresponding to three colors of R, G, and B. On the active matrix substrate 34 are formed active elements such as TFT 21*i,j* or a like shown in FIG. 2. The backlight 16 is mounted on a rear of the liquid crystal display panel 14 and, in the embodiment in particular, is configured to use light of R, G, and B fed from the LEDs as a flat light source and to have approximately the same size as the display screen of the liquid crystal display 14 as a whole.

In the liquid crystal display panel 14, white light from the backlight 16 becomes linearly polarized light after the passage through the polarizer 32 and then enters the liquid crystal layer 35. The liquid crystal layer 35 is made up of a TN (Twisted Nematic)-type liquid crystal and acts to change a shape of polarized light, however this action is defined by an orientation state of the liquid crystal and, therefore, the shape of polarized light is controlled by a gray level voltage corresponding to the display signal "Di". Whether or not emitted light is absorbed by the polarizer 32 is determined by the shape of polarized light emitted from the liquid crystal layer 35. Thus, optical transmittance of the liquid crystal is controlled by a gray level voltage corresponding to the display signal "Di". Color images are obtained by additive mixture of color stimuli of light passed through each pixel of R, G, and B of the color filter.

Figure 4:
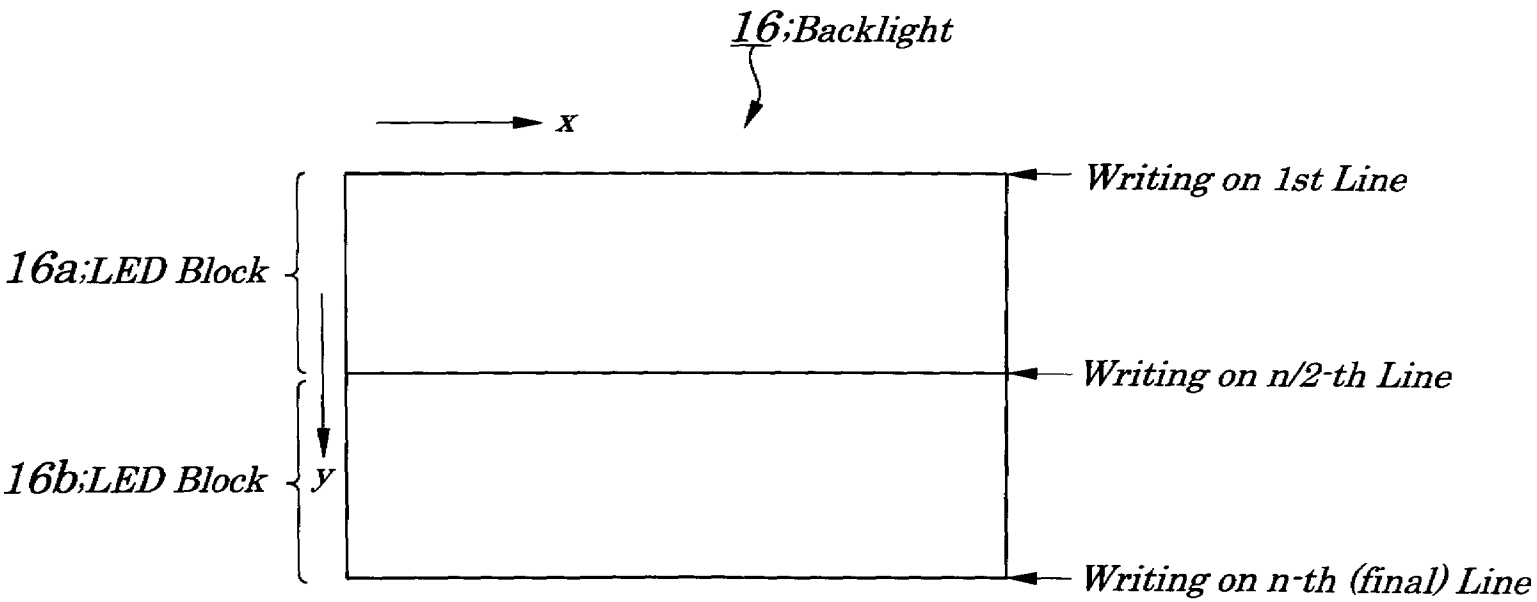
FIG. 4 is a diagram showing main portions of the backlight in FIG. 1.

FIG. 4 is a diagram showing main portions of the backlight 16 in FIG. 1. In the backlight 16, its light-emitting region, as shown in FIG. 4, is divided into two portions, LED blocks 16*a* and 16*b*, in a y direction of the liquid crystal display panel 14. In this case, the scanning signal "OUTj" is line-sequentially written (applied) to the liquid crystal display panel 14 in a direction from the first line to the n-th line (final line), however, the backlight 16 is divided in the neighborhood of the n/2-th line. When the backlight 16 is divided as in the first embodiment, the video signal detecting section 21 detects the brightest gray level for each of the R, G, and B of the input video signal VD corresponding to 1, . . . , n/2 line and the brightest gray level for each of the R, G, and B of the input video signal VD corresponding to (n+1)/2, . . . , n line.

Figure 5:
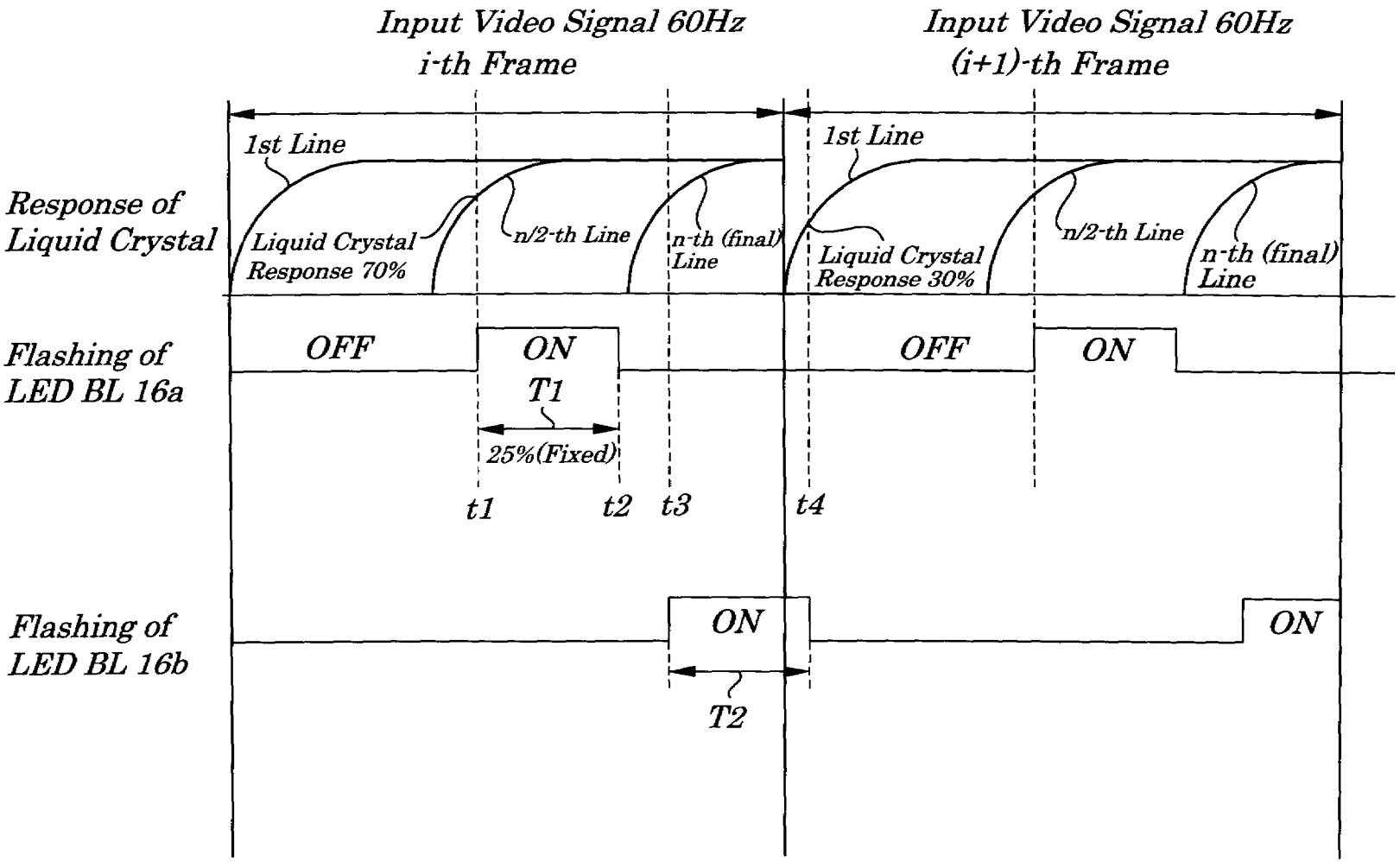
FIG. 5 is a time chart explaining operations of the liquid crystal display device in FIG. 1.
Figure 6:
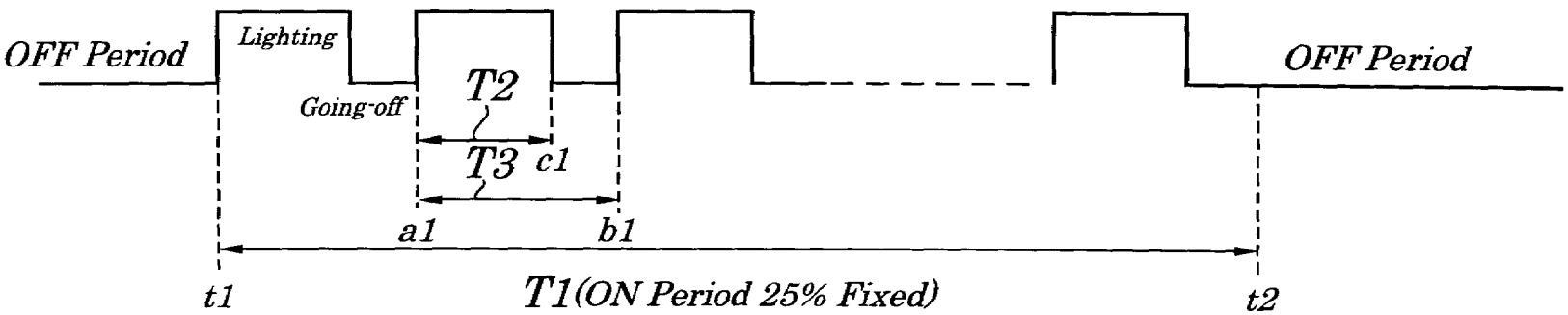
FIG. 6 is a diagram showing an ON operation period of FIG. 5 expanded in a time axis direction.

FIG. 5 is a time chart explaining operations of a liquid crystal display device in FIG. 1. FIG. 6 is a diagram showing a period of ON operations in FIG. 5 expanded in a time axis direction. A method for driving the liquid crystal display device of the embodiment is explained by referring to these drawings. In the liquid crystal display device, each of the LED blocks is turned ON, for a specified period, according to a response of the liquid crystal for a light emitting region of each of the LED blocks and the brightest gray level for each of the R, G, and B of the input video signal VD, in a manner to correspond to each of the LED blocks 16*a* and 16*b*, is detected in every frame period and the input video signal VD is converted into a signal value obtained by being multiplied by the upper limit gray level and then by being divided by the brightest gray level. Then, a gray level voltage corresponding to the converted value is applied to each of the data electrodes and, during the period of lighting of each of the LED blocks 16*a* and 16*b*, each of the LED blocks 16*a* and 16*b* flashes at a duty proportional to a rate of the brightest gray level to the upper limit gray level of the input video signal VD.

That is, the brightest gray level, in every frame period, for R, G, and B of the input video signal VD, in a manner to correspond to each of the LED blocks 16*a* and 16*b*, is detected by the video signal detecting section 21 and the brightest gray level is sent out as the maximum gray level "grh" to the video signal converting section 22 and the LED luminance converting section 23. The video signal "fvj" of the input video signal VD, in every frame period, is transmitted to the frame memory 11. The video signal "fvj" is stored in the frame memory 11 and is sent out as a video signal "fvq" to the video signal converting section 22. The video signal converting section 22 converts the video signal "fvq" fed from the frame memory 11 into a signal value obtained by being multiplied by the upper limit gray level (64 gray levels) of the input video signal VD and by being divided by the maximum gray level "grh" and sends out the converted value as the converted video signal data "fvr" to the H-driver 12. In this case, for example, if the maximum gray level "grh" is 32 gray levels, the 32 gray levels are converted by the video signal converting section 22, into 64 gray levels and 10 gray levels into 20 gray levels (=10 gray levels of the input video signal×64 gray levels/maximum 32 gray levels).

Moreover, in the timing control section 25, the control signal "cta" is generated based on the input timing signal "tp" and is sent out to the H-driver 12 and the control signal "ctb" is generated and sent out to the V-driver 13. In the H-driver, based on the control signal "cta" fed from the timing control section 25 and the converting video signal "fvr" fed from the video signal converting section 22, the display signal "Di" is generated and sent out to the liquid crystal display panel 14. In the V-driver, based on the control signal "ctb" fed from the timing control section 25, the scanning signal "OUTj" is generated and sent out to the liquid crystal display panel 14. In the liquid crystal display panel 14, by a driving operation of each of the scanning electrodes Yj (not shown) and each of the data electrodes Xi (not shown), a gray level voltage corresponding to the display signal "Di" is applied to a corresponding pixel region and a response of the liquid crystal in the corresponding region is controlled for image displaying.

On the other hand, in the LED luminance converting section 23, during the period of lighting of each of the LED blocks 16*a* and 16*b*, the control signal "ctu" used to make each of the LED blocks 16*a* and 16*b* flash is generated at a duty proportional to a rate of the maximum gray level "grh" to the upper limit gray level of the input video signal VD. For example, if the maximum gray "grh" is 32 gray levels, the control signal "ctu" is generated so that luminance of each of the LED blocks 16*a* and 16*b* is 50% (that is, maximum gray level "grh" [32 gray level]/upper limit gray level [64 gray level]). In the lighting timing control section 24, according to a response of the liquid crystal for the light-emitting region of each of the LED blocks 16*a* and 16*b*, the control signal "ctv" used to make each of the LED blocks 16*a* and 16*b* flash is generated at a duty based on the control signal "ctu" of each of the LED blocks 16*a* and 16*b* and is sent out to the LED driver 15.

In this case, as shown in FIG. 5, the lighting period T1 (from time t1 to time t2) of the LED block 16*a* is a period (fixed 25% of liquid crystals show a response) from the time point when 70% or more liquid crystals on the n/2-th line in the i-th frame ("i" is an integer) shown a response to the time point when 30% or less liquid crystals on the 1-st line in the (i+1)-th frame have a response. Therefore, a lighting start time point needs to be within a range of the time t1 to the time t3 and lighting end time point needs to be within a range of the time t2 to the time t4. Similarly, the lighting period T2 is a period (fixed 25% of liquid crystals shows a response) from the time point when 70% or more liquid crystals on the n-th line in the i-th frame shown a response to the time point when 30% or less liquid crystals on the n/2-th line in the (i+1)-th frame have a response.

In the LED driver 15, based on the control signal "ctv" fed from the lighting timing control section 24, driving voltage "dw1" and "dw2" used to make each of the LED blocks flash are generated. Each of the LED blocks 16*a* and 16*b*, as shown in FIG. 6, by the application of the driving voltages "dw1" and "dw2", flashes at a duty proportional to a rate of the maximum gray level "grh" to the upper limit gray level of the input video signal VD. For example, if the luminance of each of the LED blocks 16*a* and 16*b* is 50%, the luminance during the period T (from time a1 to time c1) is 50% of the luminance during the period T3 (from time a1 to time b1). In this case, the lighting time period T1 is made up of two or more periods each having a time width from the time a1 to the time b1. In the embodiment, the period from the time a1 to the time b1 and timing of lighting are fixed to be a specified value which is not changed by the input video signal VD.

Thus, in the first embodiment, each of the LED blocks 16*a* and 16*b* is turned ON for a specified period of time according to a response of the liquid crystal for a light-emitting region of each of the LED blocks 16*a* and 16*b* and the brightest gray level, in every frame period, for each color of red (R), green (G), and blue (B) of the input video signal VD is detected in a manner to correspond to each of the LED blocks 16*a* and 16*b* and the input video signal VD is converted into a signal value obtained by being multiplied by the upper limit gray level and by being divided by the brightest gray level and a gray level voltage corresponding to the converted signal value is applied to each of the data electrodes and each of the LED blocks 16*a* and 16*b* flashes at a duty proportional to a rate of the brightest gray level to the upper limit gray level of the input video signal VD and, therefore, trail-leaving occurring at a time of display of images is reduced and contrast of displayed images and a dynamic range of luminance are improved. Moreover, even when a lighting duty of each of the LED blocks 16*a* and 16*b* is changed by the input video signal VD, lighting timing and period for each of the LED blocks 16*a* and 16*b* are fixed and each of the LED blocks 16*a* and 16*b* flashes with the lighting time period divided into two periods and, as a result, the trail-leaving in moving images is reduced irrespective of the gray level.

Second Embodiment

Figure 7:
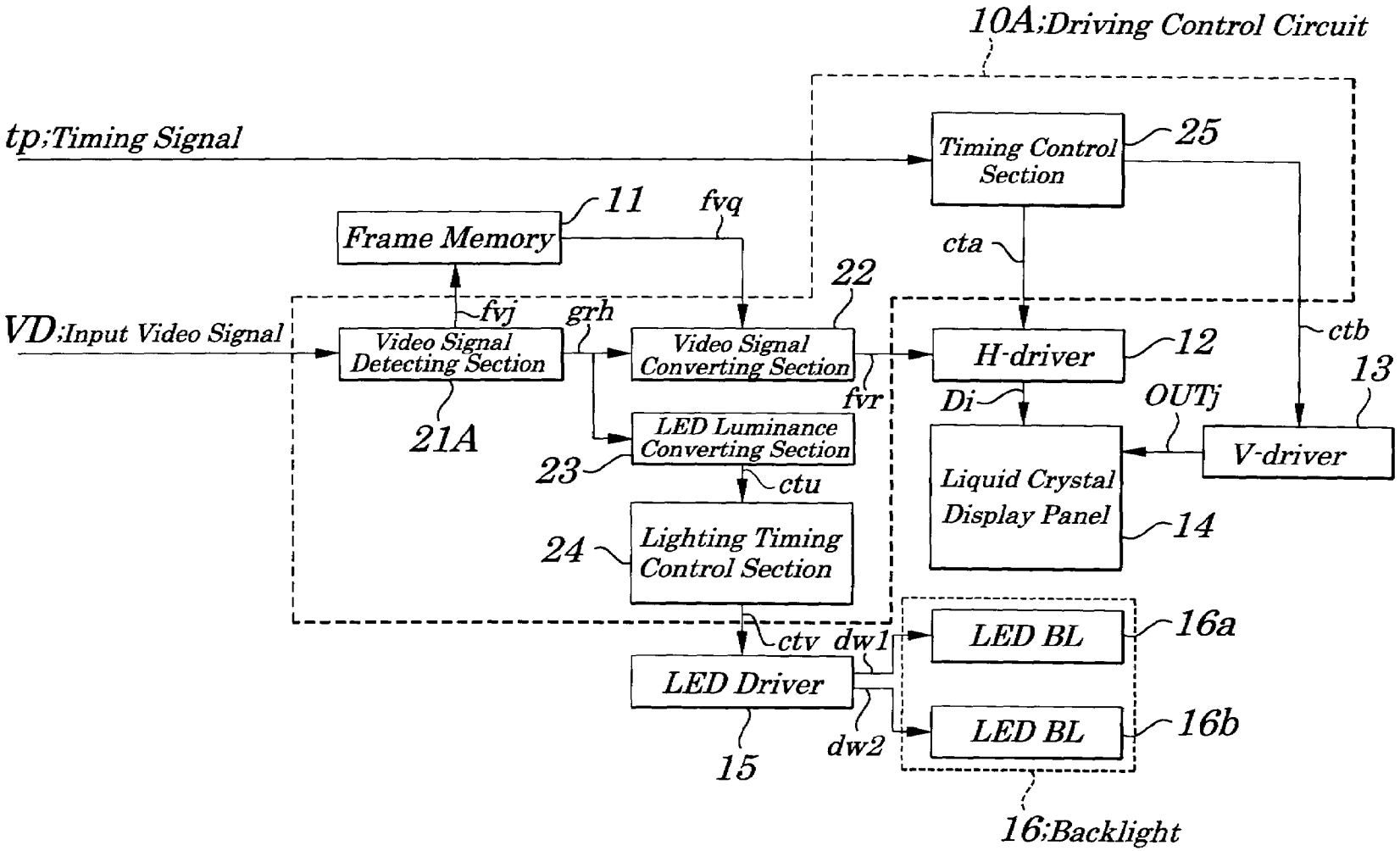
FIG. 7 is a block diagram showing electrical configurations of main components of a liquid crystal display device according to a second embodiment of the present invention.

FIG. 7 is a block diagram showing electrical configurations of main components of a liquid crystal display device of a second embodiment of the present invention. In FIG. 7, same reference numbers are assigned to components having the same functions as in the first embodiment in FIG. 1. In the liquid crystal display device of the second embodiment, as shown in FIG. 7, instead of the driving control circuit 10 shown in FIG. 1, a driving control circuit 10A having different configurations is provided newly. In the driving control circuit 10A, instead of the video signal detecting section 21A shown in FIG. 1, a video signal detecting section 21A having different configurations is provided newly. The video signal detecting section 21 detects, in a manner to correspond to each of LED blocks 16*a* and 16*b*, an average value of gray levels within a specified range including the brightest gray level for each red (R), green (G), and blue (B) of the input video signal VD in every frame period and sends out the average value, as a maximum gray level "grh", to a video signal converting section 22 and an LED luminance converting section 23 and a video signal "fvj" of the input video signal VD, to a frame memory 11 in every frame period. Moreover, when the above average value is set to be the maximum gray level "grh", the gray level of a pixel is higher than its original gray level (gray level of the input video signal VD) in some cases, where the gray level of the pixel is corrected to be an upper limit gray level. For example, in the case of an upper limit gray level being 64 gray levels, if the maximum gray level "grh" exceeds 65 gray levels, the 65 gray levels are corrected to be 64 gray levels. In addition, the average value of the above gray levels can be obtained by detecting gray levels corresponding to pixels within a specified range using the pixel having the brightest gray level as a reference in every frame period, and by averaging values resulting from the detection. In this case, for example, as the above average value, an average value of gray levels within a range of 10% of higher-order gray levels to the brightest gray level or an average value of gray levels of a pixel having the brightest gray level and of pixels surrounding the pixel having the brightest gray level is used.

In the liquid crystal display device, an average value of gray levels for each of the R, G, and B of the input video signal VD within a specified range including the brightest gray level in every frame period is detected by the video signal detecting section 21A and the detected average value is output as the maximum gray level "grf". Therefore, even if a gray level of any given pixel only is high, entire contrast of a display screen and a dynamic range of luminance are improved.

Third Embodiment

Figure 8:
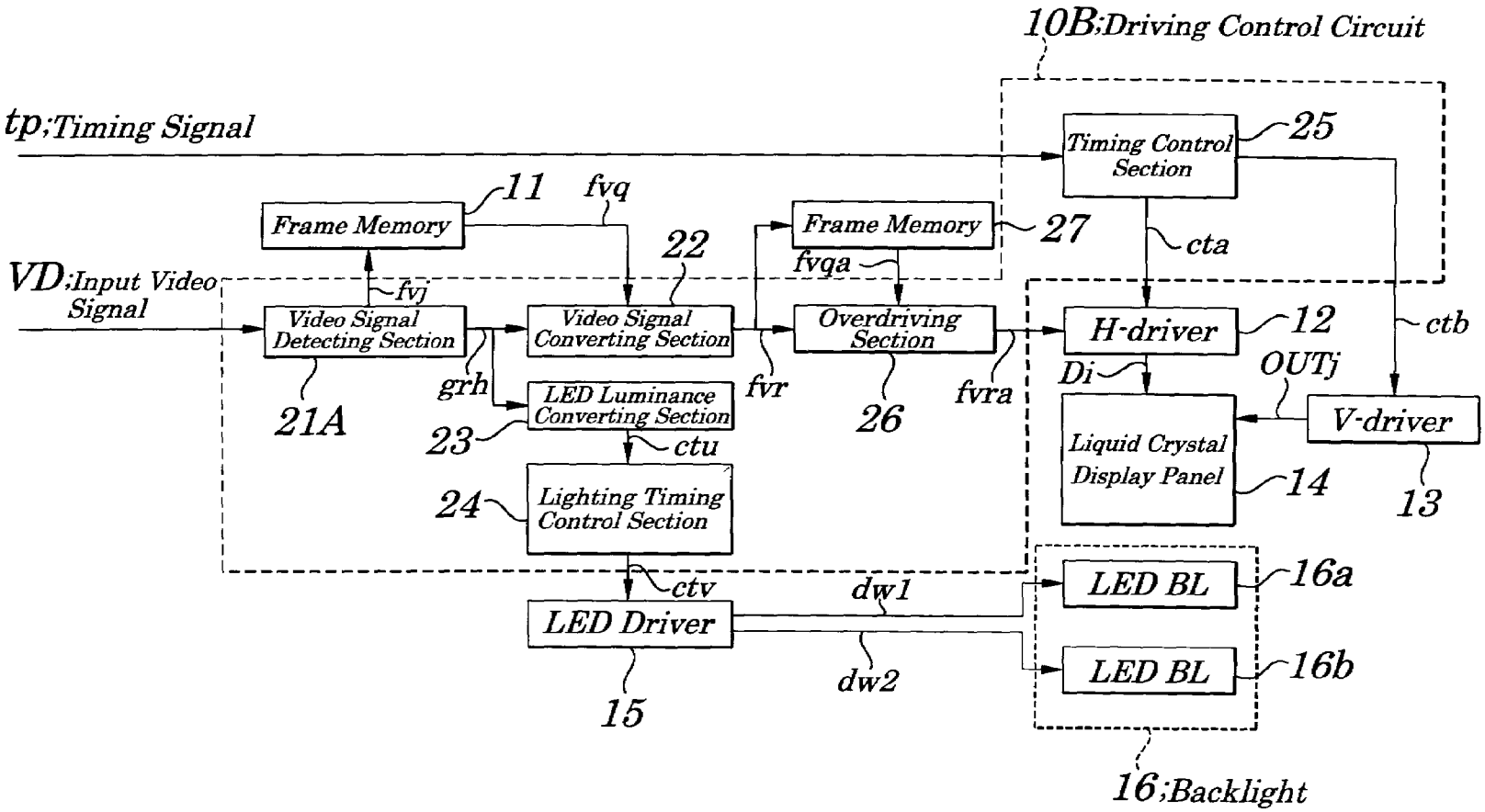
FIG. 8 is a block diagram showing electrical configurations of main components of a liquid crystal display device according to a third embodiment of the present invention.

FIG. 8 is a block diagram showing electrical configurations of main components of a liquid crystal display device according to a third embodiment of the present invention. In FIG. 8, same reference numbers are assigned to components having the same functions as in the first embodiment in FIG. 2. In the liquid crystal display device of the third embodiment, as shown in FIG. 8, instead of the driving control circuit 10A, a driving control circuit 10B having different configurations and a frame memory 27 are newly provided. An overdriving section 26 is additionally mounted in the driving control circuit 10B. The frame memory 27 stores a converting video signal "fvr" fed from the video signal converting section 22 for every frame and sends out the stored video signal as a converting video signal "fvqa" to the overdriving section 26. The overdriving section 26 converts, in synchronization with output timing of the converted video signal "fvr" output from the video signal converting section 22, the converting video signal "fvqa" to a signal having a level to perform an overdriving operation, for every frame, on each of pixel regions 20

*m,n* in the liquid crystal display panel 14 and sends out the converted signal as a converted video signal "fvra" to an H-driver 12.

Thus, in the liquid crystal display device of the third embodiment, the overdriving operation is performed, in every frame period, on each of the pixel regions 20 *m,n* of the liquid crystal display panel 14 and, therefore, a response of a liquid crystal is more rapid than that in the second embodiment, which reduces a trail-leaving more.

Fourth Embodiment

Figure 9:
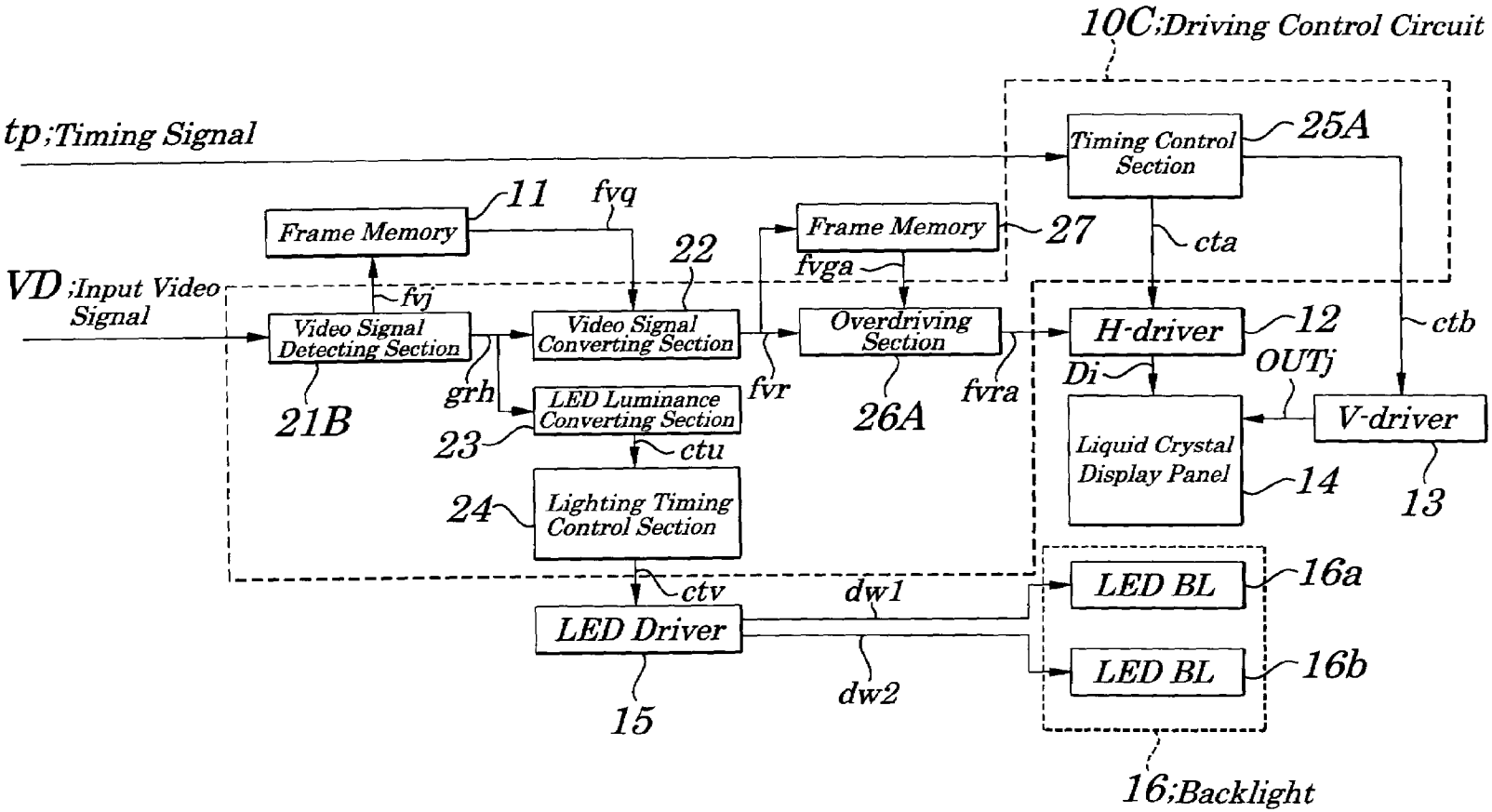
FIG. 9 is a block diagram showing electrical configurations of main components of a liquid crystal display device according to a fourth embodiment of the present invention.

FIG. 9 is a block diagram showing electrical configurations of main components of a liquid crystal display device according to a fourth embodiment of the present invention. In the liquid crystal display device of the fourth embodiment, as shown in FIG. 9, instead of the driving control circuit 10B shown in FIG. 8, a driving control circuit 10C having different configurations is newly provided. In the driving control circuit 10C, instead of the video signal detecting circuit 21A, overdriving section 26, and timing control section 25 in FIG. 8, a video signal detecting circuit 21B, overdriving section 26A, and timing control section 25A, all having functions different from those in the third embodiment, are newly provided. The video signal detecting section 21B divides each frame of the input video signal VD to be input at a specified frame frequency (for example, 60 Hz) into two sub-frames each having a sub-frame frequency being two times higher than the specified frame frequency and has a function of performing the same operation as is carried out, in every sub-frame period, by the video signal detecting section 21A.

The overdriving section 26A converts, in synchronization with output timing of the converting video signal "fvr" to be output from the video signal converting section 22, the converting video signal "fvga" fed from the frame memory 27 into a signal having a level to perform an overdriving operation in the first sub-frame period on each of the pixel regions 20 *m,n* of the liquid crystal display panel 14 and to perform an ordinary driving operation in the second sub-frame period. The timing control section 25A outputs a control signal "cta" and a control signal "ctb" to make the H-driver and V-driver operate at a speed of two times higher than the speed employed in the above third embodiment. Moreover, the frame frequency is 60.00 Hz in the case of the specifications of the liquid crystal display panel 14 being, for example, XGA (Extended Graphics Array), 59.94 Hz in the case of the specification being VGA (Video Graphics Array) and 60.32 Hz in the case of the specification being SVGA (Super Video Graphics Array).

Figure 10:
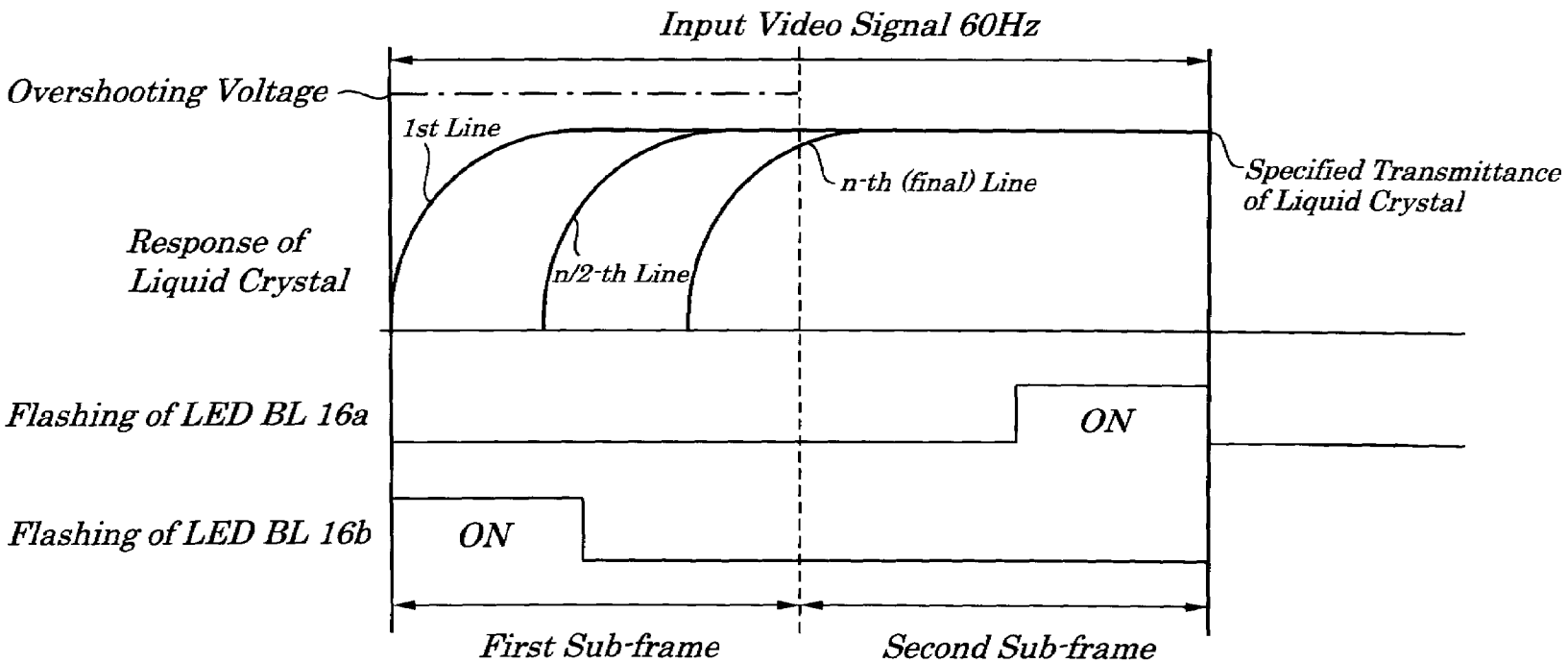
FIG. 10 is a time chart explaining operations of the liquid crystal display device in FIG. 9.

Thus, in the liquid crystal display device of the fourth embodiment, as shown in FIG. 10, the H-driver 12 and V-driver 13 are made by the timing control section 25A to operate at a speed being two times higher than the speed in the third embodiment and, therefore, when each of the LED blocks flashes, a response of the liquid crystal becomes faster, which reduces trail-leaving of moving images more.

Fifth Embodiment

Figure 11:
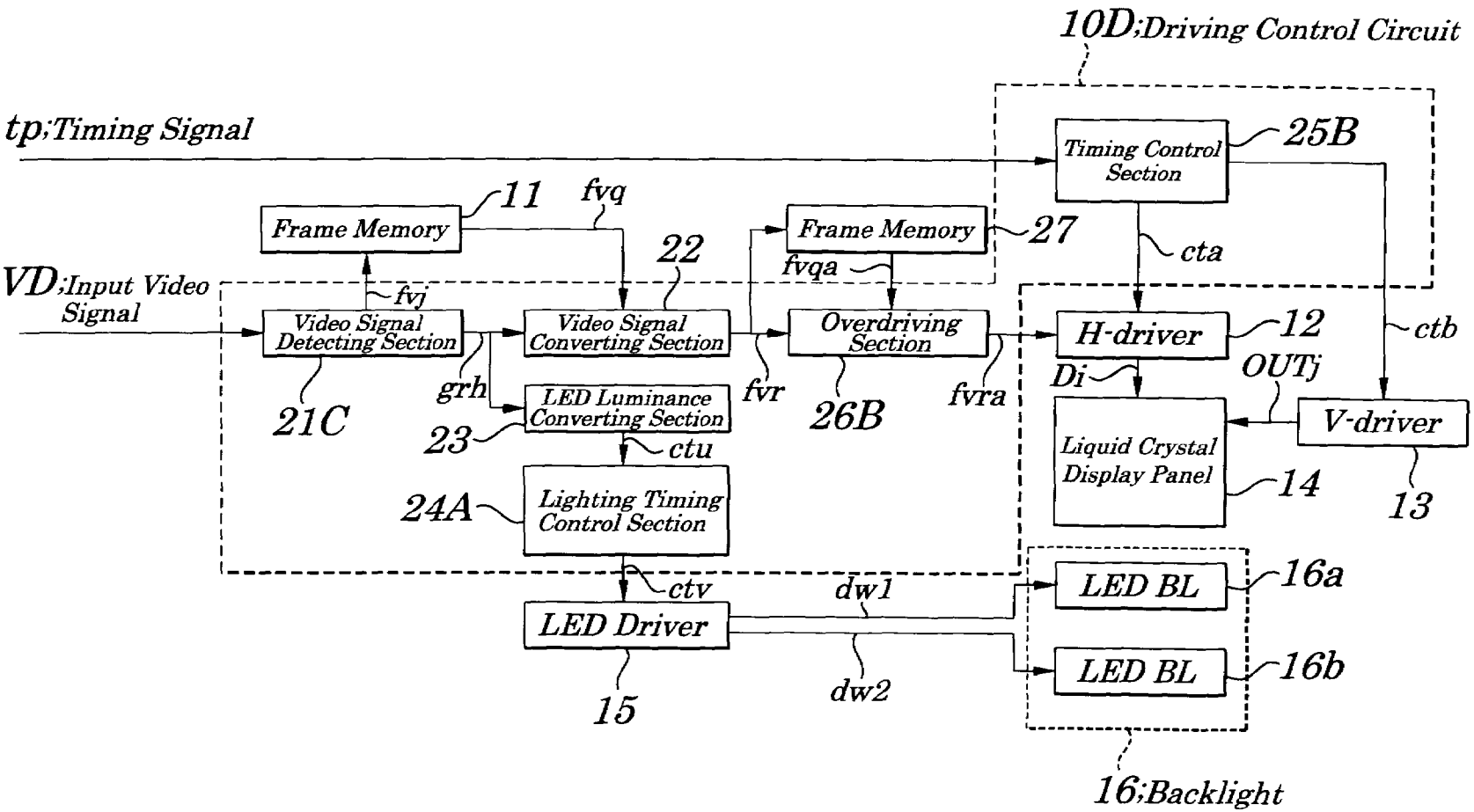
FIG. 11 is a block diagram showing electrical configurations of main components of a liquid crystal display device according to a fifth embodiment of the present invention.

FIG. 11 is a block diagram showing electrical configurations of main components of a liquid crystal display device of a fifth embodiment of the present invention. In the liquid crystal display device of the fifth embodiment, as shown in FIG. 11, instead of the driving control circuit 10C in FIG. 9, a driving control circuit 10D having different configurations is newly provided. In the driving control circuit 10D, instead of the video signal detecting section 21B, overdriving section 26A, lighting timing control section 24, and timing control section 26B all shown in FIG. 9, a video signal detecting section 21C, overdriving section 26C, lighting timing control section 24*a*, and timing control section 25B each having functions different from those shown in FIG. 9 are newly provided. The video signal detecting section 21C divides each frame of the input video signal VD into four sub-frames (first sub-frame to fourth sub-frame) each having a sub-frame frequency (240 Hz) being four times higher than the specified frame frequency and has a function of performing the same operation as is carried out, in each sub-frame period.

The overdriving section 26B converts, in synchronization with output timing of the converting video signal "fvr" to be output from the video signal converting section 22, the converting video signal "fvqa" fed from the frame memory 27 into a signal having a level to perform an overdriving operation in the first sub-frame period on each of the pixel regions 20 *m,n* of the liquid crystal display panel 14 and to perform an ordinary driving operation in the second to fourth sub-frame. The lighting timing control section 24A, during every frame period, makes each of the LED blocks 16*a* and 16*b* be turned ON twice at specified intervals and a lighting frequency is set to be 120 Hz in the fifth embodiment. The timing control section 25B outputs control signals "cta" and "ctb" used to make the H-driver 12 and V-driver 13 operate at a speed being four times higher than the speed employed in the above third embodiment.

Figure 12:
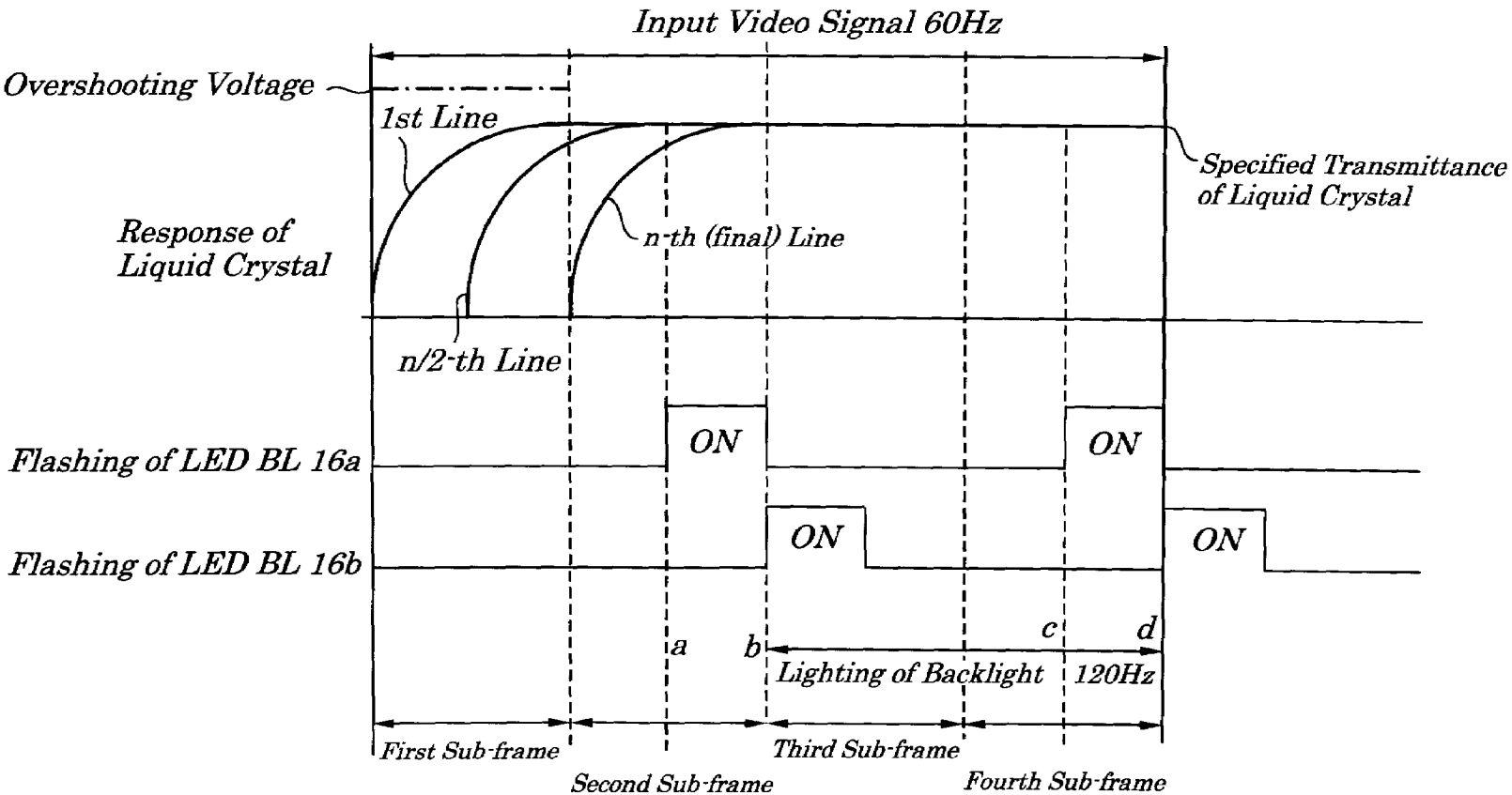
FIG. 12 is a time chart explaining operations of the liquid crystal display device in FIG. 11.

Thus, in the liquid crystal display device of the fifth embodiment, as shown in FIG. 12, lighting frequency of each of the LED blocks 16*a* and 16*b* becomes 120 Hz and, therefore, less flicker is visually recognized compared with the case where the lighting frequency is 60 Hz. Moreover, in the third sub-frame to fourth sub-frame, no writing to the liquid crystal is permissible, however, in the first sub-frame to second sub-frame, a polarity of a gray-level voltage for writing to the liquid crystal is inverted.

Sixth Embodiment

Figure 13:
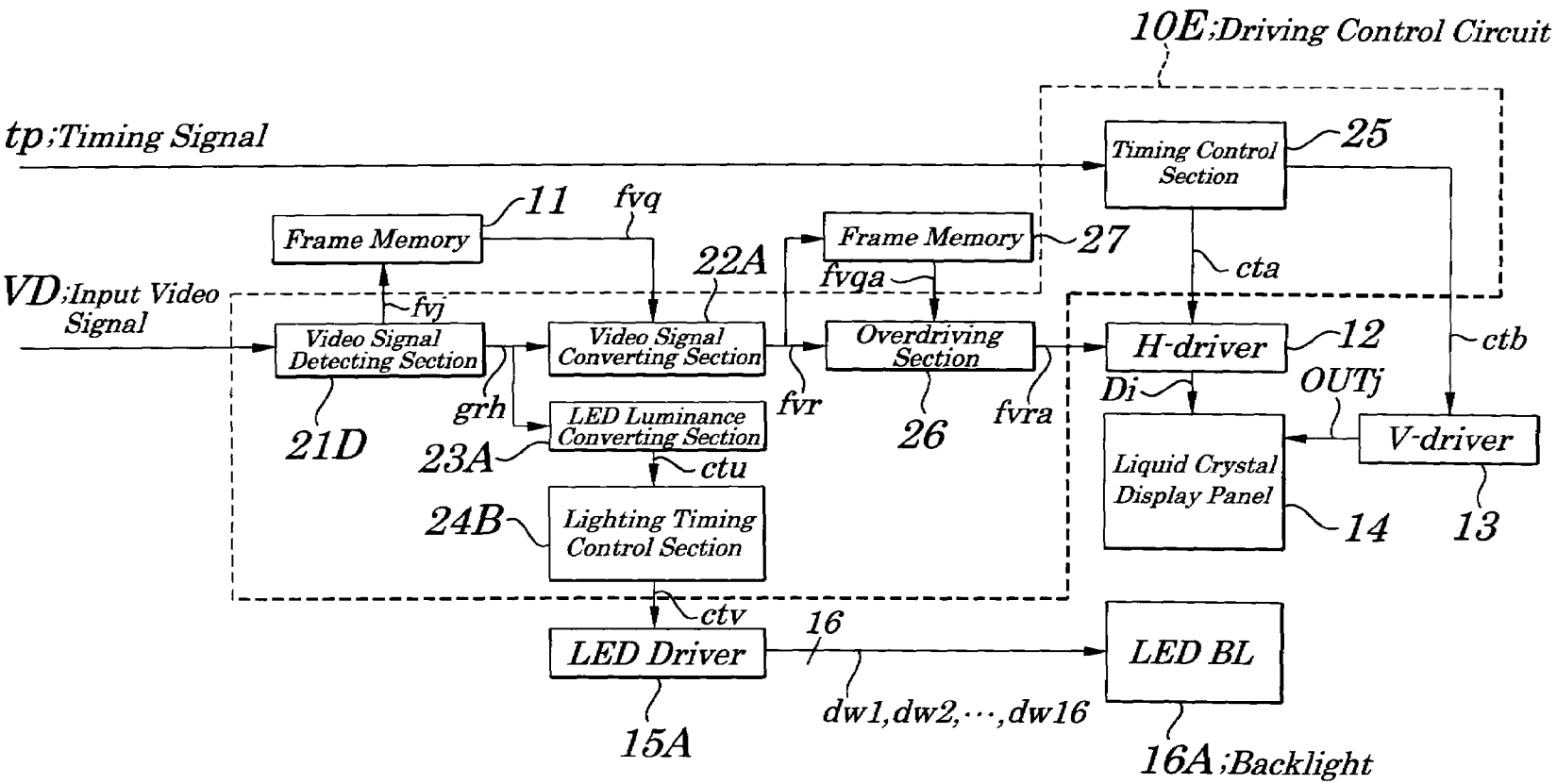
FIG. 13 is a block diagram showing electrical configurations of main components of a liquid crystal display device according to a sixth embodiment of the present invention.

FIG. 13 is a block diagram showing electrical configurations of main components of a liquid crystal display device of a fifth embodiment of the present invention. In the liquid crystal display device of the sixth embodiment, as shown in FIG. 13, instead of the driving control circuit 10B, LED driver 15, backlight 16 all shown in FIG. 8, a driving control circuit 10E, LED driver 15A, and a backlight 16A are newly provided.

Figure 14:
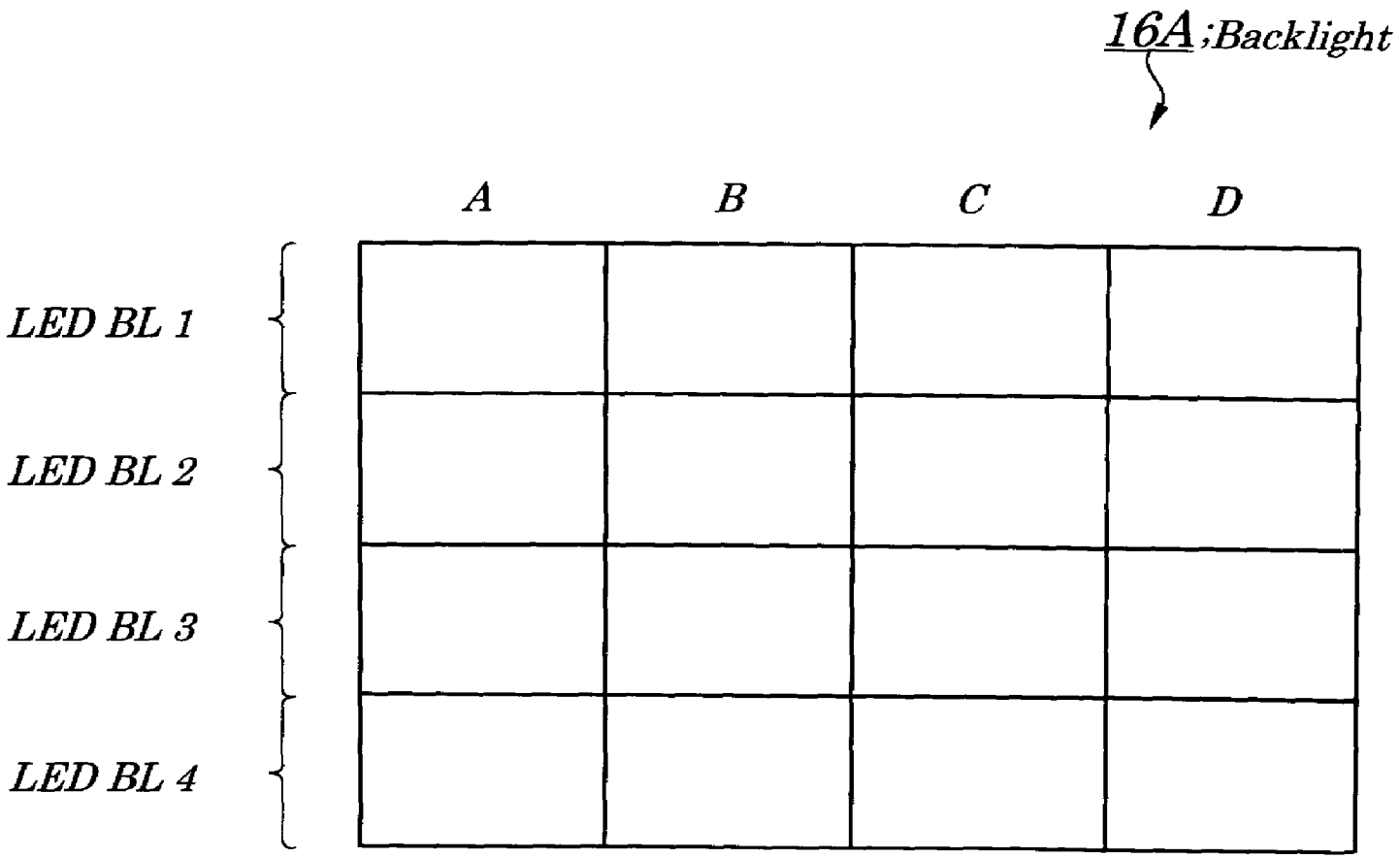
FIG. 14 is a diagram showing configurations of main components of a backlight shown in FIG. 13.
Figure 15:
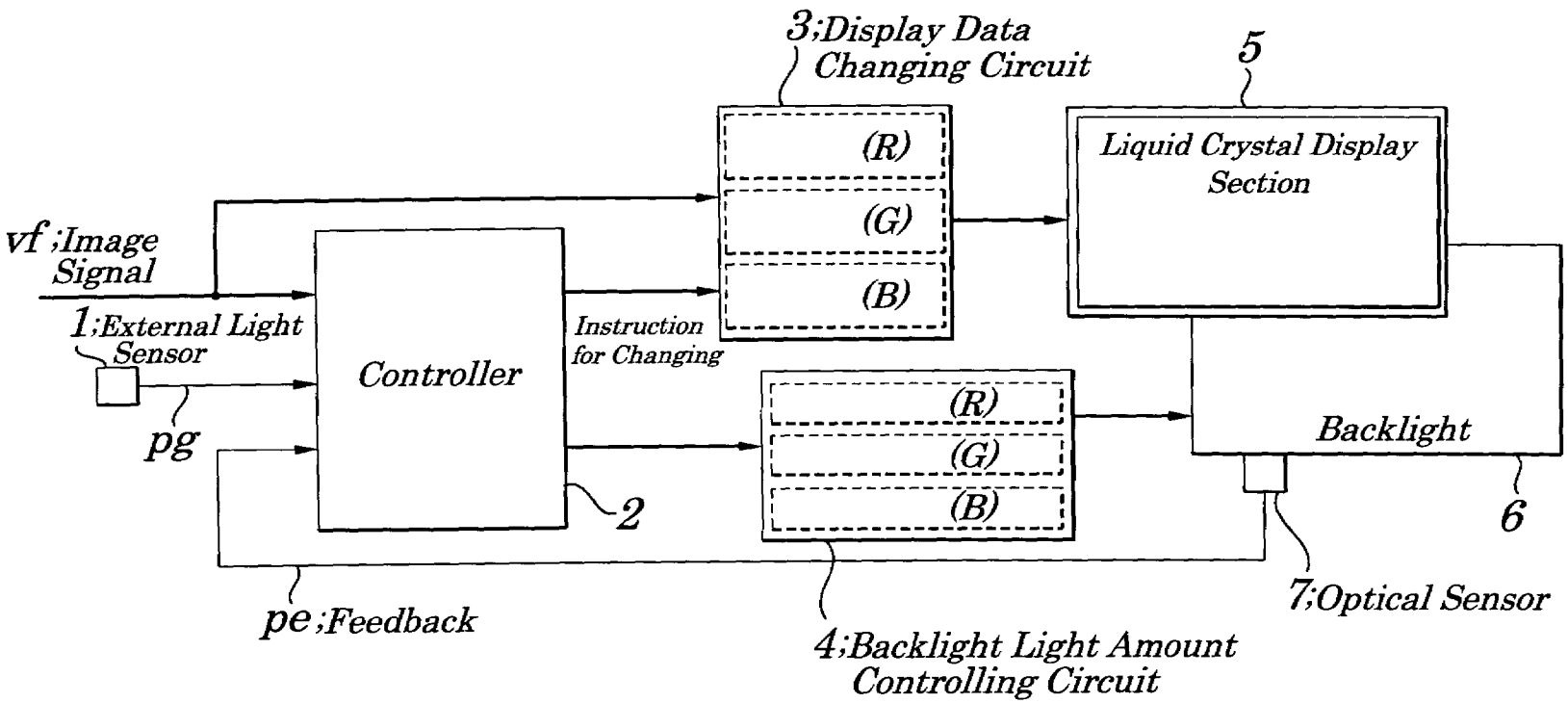
FIG. 15 (RELATED ART)
FIG. 15 is a block diagram showing electrical configurations of main components of a related art liquid crystal display device.
Figure 16:
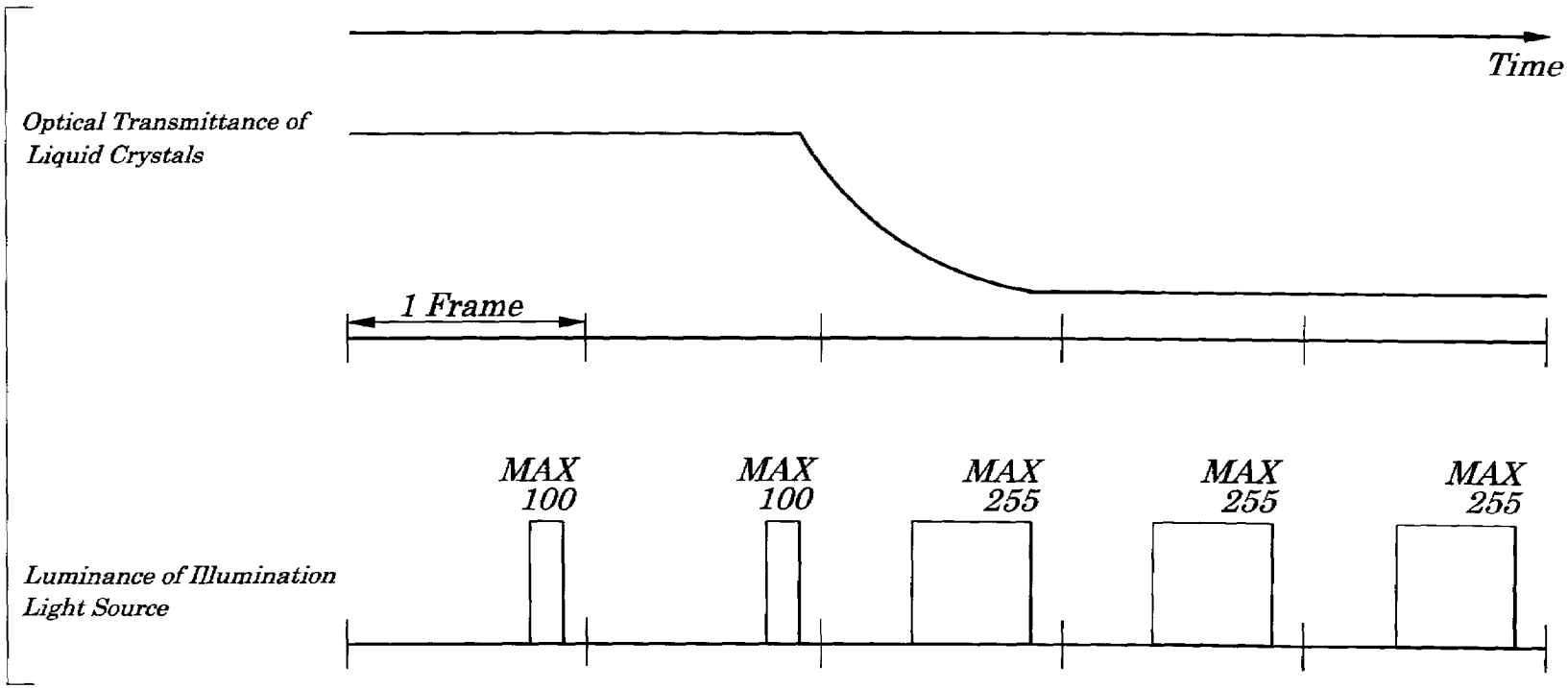
FIG. 16 (RELATED ART)
FIG. 16 is a diagram explaining operations of the related art liquid crystal display device of FIG. 15.
Figure 17A:
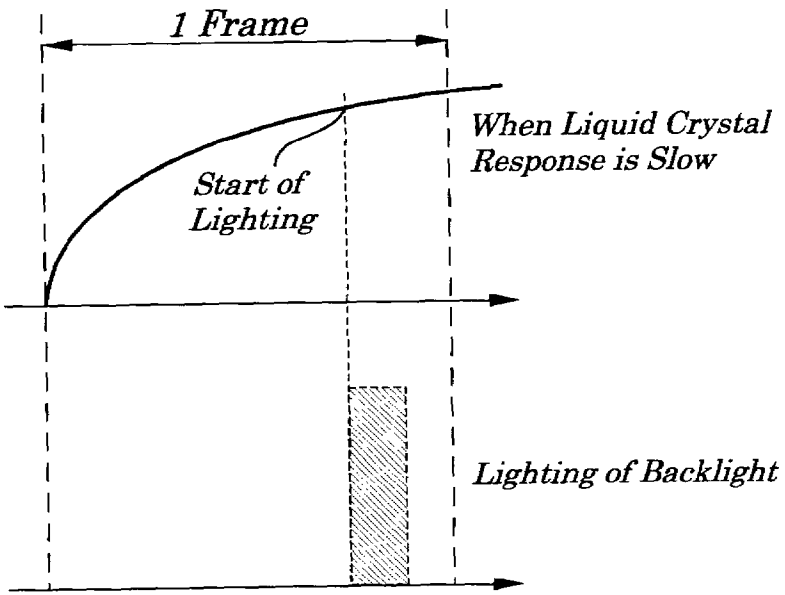
FIG.17A (RELATED ART)
FIGS. 17A and 17B are a diagram explaining problems of the related art liquid crystal display device of FIG. 15.
Figure 17B:
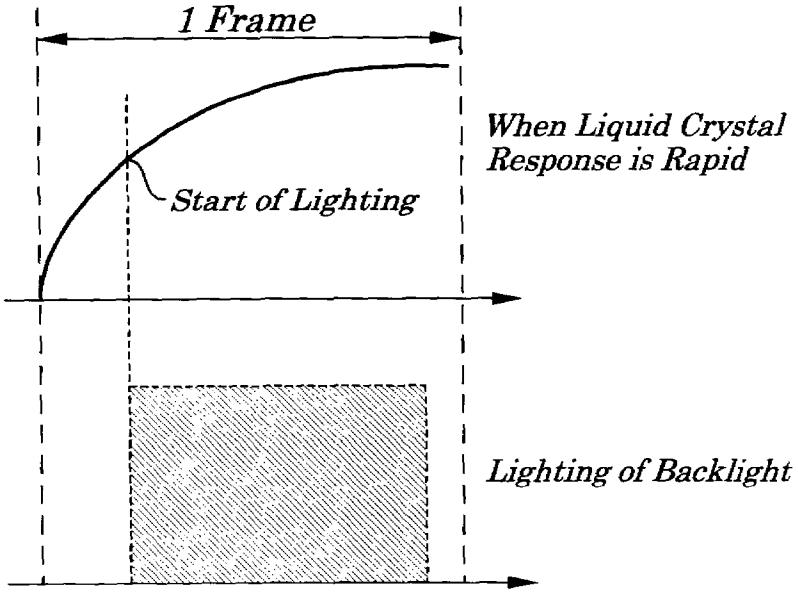
FIG.17B (RELATED ART)

FIG. 14 is a diagram showing main components of the backlight in FIG. 13. The backlight 16A, as shown in FIG. 14, is divided into 4 rows×4 columns and is made up of LED block 1A, 1B, 1C, 1D, 2A, 2B, 2C, 2D, 3A, 3B, 3C, 3D, 4A, 4B, 4C, and 4D. In the driving control circuit 10E, instead of the video signal detecting section 21A, video signal converting section 22, LED luminance converting section 23, and lighting timing control section 24 shown in FIG. 8, a video signal detecting section 21D to perform the same operations as above in a manner to correspond to each LED block of the LED driver, a video signal converting section 22A, an LED luminance converting section 23A, and a lighting timing control section 24B are provided. The LED driver 15A generates, based on a control signal "ctv" fed from the lighting timing control section 24B, driving voltages "dw1, dw2, . . . , dw16" each of which drives each of the LED blocks.

In the liquid crystal display device of the sixth embodiment, instead of the operations performed in a manner to correspond to each of the LED blocks 16*a* and 16*b* in the third embodiment, operations are performed in a manner to correspond to each LED block of the LED driver 15A. In this case, each of the LED blocks of the LED driver 15A gets into an ON state in the same period and same timing on each line. For example, the LED blocks 1A, 1B, 1C, and 1D get into an ON state at the same time, however, a duty for flashing in the ON state is controlled for each of the LED blocks 1A, 1B, 1C, and 1D. Moreover, the converting video signal "fvr" fed from the video signal converting section 22A is also output in a manner to correspond to each LED block of the LED driver 15A. Thus, more subdivided operations corresponding to each LED block of the LED driver are performed and, therefore, a resolution on the display screen is improved.

It is apparent that the present invention is not limited to the above embodiments but may be changed and modified without departing from the scope and spirit of the invention. For example, in each of the above embodiments, the H-driver 12 applies, based on the control "cta", a display signal "Di" corresponding to the input video signal VD, simultaneously to each of the data electrodes Xi of the liquid crystal display panel, however, alternatively, the display signal "Di" may be applied point-sequentially to each of the data electrodes Xi. Also, the lighting period of the LED blocks 16*a* and 16*b* in one time is not limited to 12.5% of the frame period. The configurations of the liquid crystal display panel in FIG. 1 are not limited to those shown in FIGS. 2 and 3 and an IPS (In-Plane-Switching)-type liquid crystal display device may be used. In all embodiments except the sixth embodiment, alternatively, the driving may be carried out for every LED block by using the backlight 16A in FIG. 13. Even if the backlight 16 is configured not to be divided into a plurality of LED blocks, similar actions and effects as obtained in each of the embodiments can be achieved. As the color for the LEDs of the backlights 16, 16A, in addition to R, G, and B, deep red may be used. In this case, the configurations of the driving control circuits 10, 10A, 10B, 10C, 10D, and 10E in each of the above embodiments need to correspond to those of the backlights 16 and 16A.

Moreover, the present invention in which the backlight is made up of LEDs can be applied to, for example, liquid crystal display devices of all types to display moving images such as a liquid crystal television set.

What is claimed is:

1. A liquid crystal display device comprising:

a liquid crystal display panel;

a backlight; and a driving control unit;

wherein said liquid crystal display panel displays images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage;

wherein said backlight illuminates the liquid crystal display panel from its rear side; and wherein said driving control unit turns off said backlight during a frame period of said input video signal in which an upper limit gray level for each of red (R), green (G), and blue (B) is set until the liquid crystal shows a response to the application of said specified gray level voltage in said pixel region and turns on said backlight at a point of time when the liquid crystal has shown a response and detects a brightest gray level for each of the R, G, and B of said input video signal in every frame period and converts a gray level for each of the R, G, and B of said input video signal into a value which is given by a following equation, whereby the detected brightest gray level and the corresponding upper limit gray level become at a same level, and the gray level voltage corresponding to the converted value is applied to the corresponding pixel region and, during a lighting period of said backlight, makes said backlight flash at a duty corresponding to a rate of said brightest gray level to the corresponding upper limit gray level:

a value =[the gray level for each of R, G, and B of the input video signal]×[the corresponding upper limit gray level]÷[the detected brightest gray level] (equation).

2. The liquid crystal display device according to claim 1, wherein the data electrodes of said liquid crystal display panel are arranged in parallel to one another at specified intervals along a first direction and the scanning electrodes are arranged in parallel to one another at specified intervals along a second direction orthogonal to said first direction and wherein said backlight comprises a plurality of light source blocks whose light emitting region is divided into m ("m" is an integer being 1 or more) portions in said first direction of said liquid crystal display device and into k ("k" is an integer being 2 or more) portions in said second direction and wherein said driving control unit turns on the light source blocks during a specified period according to a response of the liquid crystal corresponding to the light emitting region of each of said light source blocks and detects a brightest gray level for each of the R, G, and B of said input video signal in each frame period in a manner to correspond to each of the light source blocks and converts a gray level of said input video signal so that the detected brightest gray level and said upper limit gray level become at a same level and, during a lighting period of said light source blocks, makes said backlight flash at a duty corresponding to a rate of said brightest gray level to said upper limit gray level.

3. The liquid crystal display device according to claim 1, wherein said backlight comprises LEDs (Light Emitting Diodes) of, each at least, the R, G, and B.

4. The liquid crystal display device according to claim 1, wherein said point of time when the liquid crystal has shown a response is set to be a first point of time when approximately up to 70% of the liquid crystals have shown a response or to be a second point of time after said first point.

5. The liquid crystal display device according to claim 1, wherein said driving control unit performs an overdriving operation to said pixel region in every frame period.

6. The liquid crystal display device according to claim 1, wherein said driving control unit divides each frame of said input video signal input at a specified frame frequency into M ("M" is an integer being 2 or more) pieces of sub-frames having a sub-frame frequency M times higher than said frame frequency and performs an overdriving operation on the corresponding pixel region in the first sub-frame in every frame period and performs an ordinary driving operation in the second and thereafter sub-frames.

7. The liquid crystal display device according to claim 1, wherein said driving control unit turns on said backlight N ("N" is an integer being 2 or more) times at specified intervals in every frame period.

8. A liquid crystal display device comprising:

a liquid crystal display panel;

a backlight; and a driving control unit;

wherein said liquid crystal display panel displays images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage;

wherein said backlight illuminates the liquid crystal display panel from its rear side; and wherein said driving control unit turns off said backlight during a frame period of said input video signal in which an upper limit gray level for each of red (R), green (G), and blue (B) is set until the liquid crystal shows a response to the application of said specified gray level voltage in said pixel region and turns on said backlight at a point of time when the liquid crystal has shown a response and detects an average value of gray levels within a specified range including the brightest gray level for each of the R, G, and B of said input video signal in every frame period in a manner to correspond to each of the light source blocks and converts a gray level for each of the R, G, and B of said input video signal into a value which is given by a following equation, whereby the detected average value of gray levels and the corresponding upper limit gray level become at a same level, and the gray level voltage corresponding to the converted value is applied to the corresponding pixel region and, during a lighting period of said backlight, makes said backlight flash at a duty corresponding to a rate of said average value to the corresponding upper limit gray level:

a value =[the gray level for each of R, G, and B of the input video signal]×[the corresponding upper limit gray level]±[the detected brightest gray level] (equation).

9. The liquid crystal display device according to claim 8, wherein the data electrodes of said liquid crystal display panel are arranged in parallel to one another at specified intervals along a first direction and the scanning electrodes are arranged in parallel to one another at specified intervals along a second direction orthogonal to said first direction and wherein said backlight comprises a plurality of light source blocks whose light emitting region is divided into m ("m" is an integer being 1 or more) portions in said first direction of said liquid crystal display device and into k ("k" is an integer being 2 or more) portions in said second direction and wherein said driving control unit turns on the light source blocks during a specified period according to a response of the liquid crystal corresponding to a light emitting region of each of said light source blocks and detects an average value of gray levels within a specified range including a brightest gray level for each of the R, G, and B of said input video signal in every frame period in a manner to correspond to each of said light source blocks and converts a gray level of said input video signal so that the detected average value of gray levels and said upper limit gray levels become at a same level and, during a lighting period of said backlight, makes said backlight flash at a duty corresponding to a rate of said average value to said upper limit gray level.

10. The liquid crystal display device according to claim 8, wherein an average value of said gray levels is obtained by detecting gray levels corresponding to pixels within a specified range and by averaging values resulting from the detection, using a pixel having the brightest gray level in every frame period as a reference.

11. The liquid crystal display device according to claim 8, wherein said backlight comprises LEDs (Light Emitting Diodes) of, each at least, the R, G, and B.

12. The liquid crystal display device according to claim 8, wherein said point of time when the liquid crystal has shown a response is set to be a first point of time when approximately up to 70% of the liquid crystals have shown a response or to be a second point of time after said first point.

13. The liquid crystal display device according to claim 8, wherein said driving control unit performs an overdriving operation to said pixel region in every frame period.

14. The liquid crystal display device according to claim 8, wherein said driving control unit divides each frame of said input video signal input at a specified frame frequency into M ("M" is an integer being 2 or more) pieces of sub-frames having a sub-frame frequency M times higher than said frame frequency and performs an overdriving operation on the corresponding pixel region in the first sub-frame in every frame period and performs an ordinary driving operation in the second and thereafter sub-frames.

15. The liquid crystal display device according to claim 8, wherein said driving control unit turns on said backlight N ("N" is an integer being 2 or more) times at specified intervals in every frame period.

16. A driving control circuit to be used in a liquid crystal display device comprising a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, said driving control circuit comprising:

components to turn off said backlight during a frame period of said input video signal in which an upper limit gray level for each of red (R), green (G), and blue (B) is set until the liquid crystal shows a response to the application of said specified gray level voltage in said pixel region and to turn on said backlight at a point of time when the liquid crystal has shown a response and to detect a brightest gray level for each of the R, G, and B of said input video signal in the frame period and to convert a gray level for each of the R, G, and B of said input video signal into a value which is given by a following equation, whereby the detected brightest gray level and the corresponding upper limit gray level become at a same level, and to apply the gray level voltage corresponding to the converted value to the corresponding pixel region and, during a lighting period of said backlight, to make said backlight flash at a duty corresponding to a rate of said brightest gray level to the corresponding upper limit gray level:

a value =[the gray level for each of R, G, and B of the input video signal]×[the corresponding upper limit gray level]×[the detected brightest gray level] (equation).

17. The driving control circuit according to claim 16, wherein the data electrodes of said liquid crystal display panel are arranged in parallel to one another at specified intervals along a first direction and the scanning electrodes are arranged in parallel to one another at specified intervals along a second direction orthogonal to said first direction and wherein said backlight comprises a plurality of light source blocks whose light emitting region is divided into m ("m" is an integer being 1 or more) portions in said first direction of said liquid crystal display device and into k ("k" is an integer being 2 or more) portions in said second direction and wherein said components further turns on the light source blocks during a specified period according to a response of the liquid crystal corresponding to a light emitting region of each of said light source blocks and detects a brightest gray level for each of the R, G, and B of said input video signal in every frame period in a manner to correspond to each of said light source blocks and converts a gray level of said input video signal so that the detected brightest gray level and said upper limit gray level become at a same level and, during a lighting period of said light source blocks, makes said backlight flash at a duty corresponding to a rate of said brightest gray level to said upper limit gray level.

18. The driving control circuit according to claim 16, wherein said driving control circuit comprises one integrated circuit.

19. A driving control circuit to be used in a liquid crystal display device comprising a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, said driving control circuit comprising:

components to turn off said backlight during a frame period of said input video signal in which an upper limit gray level for each of red (R), green (G), and blue (B) is set until the liquid crystal shows a response to the application of said specified gray level voltage in said pixel region and to turn on said backlight at a point of time when the liquid crystal has shown a response and to detect an average value of gray levels within a specified range including a brightest gray level for each of the R, G, and B of said input video signal in each frame period in a manner to correspond to each of said light source blocks and to convert a gray level for each of the R, G and B of said input video signal into a value which is given by a following equation, whereby the detected average value of gray levels and the corresponding upper limit gray levels become at a same level, and to apply the gray level voltage corresponding to the converted value to the corresponding pixel region and, during a lighting period of said backlight, to make said backlight flash at a duty corresponding to a rate of said average value to the corresponding upper limit gray level:

a value =[the gray level for each of R, G, and B of the input video signal]×[the corresponding upper limit gray level]÷[the detected brightest gray level] (equation).

20. The driving control circuit according to claim 19, wherein the data electrodes of said liquid crystal display panel are arranged in parallel to one another at specified intervals along a first direction and the scanning electrodes are arranged in parallel to one another at specified intervals along a second direction orthogonal to said first direction and wherein said backlight comprises a plurality of light source blocks whose light emitting region is divided into m ("m" is an integer being 1 or more) portions in said first direction of said liquid crystal display device and into k ("k" is an integer being 2 or more) portions in said second direction and wherein said components turn on the light source blocks during a specified period according to a response of the liquid crystal corresponding to a light emitting region of each of said light source blocks and detect an average value of gray levels within a specified range including a brightest gray level for each of the R, G, and B of said input video signal in every frame period in a manner to correspond to each of said light source blocks and convert a gray level of said input video signal so that the detected average value of gray levels and said upper limit gray levels become at a same level and, during a lighting period of said backlight, make said backlight flash at a duty corresponding to a rate of said average value to said upper limit gray level.

21. The driving control circuit according to claim 19, wherein said driving control circuit comprises one integrated circuit.

22. A driving method to be used to be used in a liquid crystal display device comprising a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, said driving method comprising:

turning off said backlight during a frame period of said input video signal in which an upper limit gray level for each of red (R), green (G), and blue (B) is set until the liquid crystal shows a response to the application of said specified gray level voltage in said pixel region, turning on said backlight at a point of time when the liquid crystal has shown a response, detecting a brightest gray level for each of the R, G, and B of said input video signal in the frame period, converting a gray level for each of the R, G, and B of said input video signal into a value which is given by a following equation, whereby the detected brightest gray level and the corresponding upper limit gray level become at a same level, applying the gray level voltage corresponding to the converted value to the corresponding pixel region and, during a lighting period of said backlight, making said backlight flash at a duty corresponding to a rate of said brightest gray level to the corresponding upper limit gray level:

a value =[the gray level for each of R, G, and B of the input video signals]×[the corresponding upper limit gray level]÷[the detected brightest gray level] (equation).

23. The driving method according to claim 22, wherein the data electrodes of said liquid crystal display panel are arranged in parallel to one another at specified intervals along a first direction and the scanning electrodes are arranged in parallel to one another at specified intervals along a second direction orthogonal to said first direction and wherein said backlight comprises a plurality of light source blocks whose light emitting region is divided into m ("m" is an integer being 1 or more) portions in said first direction of said liquid crystal display device and into k ("k" is an integer being 2 or more) portions in said second direction and wherein said driving method further comprises steps of turning on the light source blocks during a specified period according to a response of the liquid crystal corresponding to a light emitting region of each of said light source blocks, of detecting a brightest gray level for each of the R, G, and B of said input video signal in each frame period in a manner to correspond to each of said light source blocks, of converting a gray level of said input video signal so that the detected brightest gray level and said upper limit gray level become at a same level and, during a lighting period of said light source blocks, and of making said backlight flash at a duty corresponding to a rate of said brightest gray level to said upper limit gray level.

24. A driving method to be used in a liquid crystal display device comprising a liquid crystal display panel to display images corresponding to an input video signal by a driving operation of each of scanning electrodes and each of data electrodes by which a specified gray level voltage is applied to a corresponding pixel region and a response of a liquid crystal is controlled in the pixel region according to the applied gray level voltage and a backlight to illuminate the liquid crystal display panel from its rear side, said driving method comprising:

turning off said backlight during a frame period of said input video signal in which an upper limit gray level for each of red (R), green (G), and blue (B) is set until the liquid crystal shows a response to the application of said specified gray level voltage in said pixel region, turning on said backlight at a point of time when the liquid crystal has shown a response, detecting an average value of gray levels within a specified range including a brightest gray level for each of the R, G, and B of said input video signal in every frame period in a manner to correspond to each of said light source blocks, converting a gray level for each of the R, G, and B of said input video signal into a value which is given by a following equation, whereby the detected average value of gray levels and the corresponding upper limit gray levels become at a same level, applying the gray level voltage corresponding to the converted value to the corresponding pixel region and, during a lighting period of said backlight, and making said backlight flash at a duty corresponding to a rate of said average value to the corresponding upper limit gray level:

a value =[the gray level for each of R, G, and B of the input video signal]×[the corresponding upper limit gray level]÷[the detected brightest gray level] (equation).

25. The driving method according to claim 24, wherein the data electrodes of said liquid crystal display panel are arranged in parallel to one another at specified intervals along a first direction and the scanning electrodes are arranged in parallel to one another at specified intervals along a second direction orthogonal to said first direction and wherein said backlight comprises a plurality of light source blocks whose light emitting region is divided into m ("m" is an integer being 1 or more) portions in said first direction of said liquid crystal display device and into k ("k" is an integer being 2 or more) portions in said second direction and wherein said driving method comprises steps of turning on the light source blocks during a specified period according to a response of the liquid crystal corresponding to a light emitting region of each of said light source blocks, of detecting an average value of gray levels within a specified range including a brightest gray level for each of the R, G, and B of said input video signal in every frame period in a manner to correspond to each of said light source blocks, of converting a gray level of said input video signal so that the detected average value of gray levels and said upper limit gray levels become at a same level and, during a lighting period of said backlight, and of making said backlight flash at a duty corresponding to a rate of said average value to said upper limit gray level.

* * * * *

UNITED STATES PATENT AND TRADEMARK OFFICE

CERTIFICATE OF CORRECTION

PATENT NO. : 7,952,556 B2
APPLICATION NO. : 11/775009
DATED : May 31, 2011
INVENTOR(S) : Nobuaki Honbo It is certified that error appears in the above-identified patent and that said Letters Patent is hereby corrected as shown below:

Column 19, Line 30: In Claim 8, delete "±" and insert -- ÷ --, therefor

Column 20, Line 50: In Claim 16, delete "×" and insert -- ÷ --, therefor

Signed and Sealed this
Fourth Day of September, 2012

David J. Kappos

David J. Kappos
*Director of the United States Patent and Trademark Office*